US010993527B2

(12) United States Patent
Wiener et al.

(10) Patent No.: US 10,993,527 B2
(45) Date of Patent: May 4, 2021

(54) POWERED SIT-STAND DESK

(71) Applicant: Thermogenesis Group, Inc., Bellevue, WA (US)

(72) Inventors: Ron Wiener, Mercer Island, WA (US); Andrew Rosenbaum, Mercer Island, WA (US); Cole Dalton, Snohomish, WA (US)

(73) Assignee: Thermogenesis Group, Inc., Bellevue, WA (US)

( * ) Notice: Subject to any disclaimer, the term of this patent is extended or adjusted under 35 U.S.C. 154(b) by 64 days.

(21) Appl. No.: 16/199,516

(22) Filed: Nov. 26, 2018

(65) Prior Publication Data

US 2019/0159586 A1 May 30, 2019

Related U.S. Application Data

(60) Provisional application No. 62/590,991, filed on Nov. 27, 2017.

(51) Int. Cl.

| | |
|---|---|
| ***A47B 9/08*** | (2006.01) |
| ***A47B 21/02*** | (2006.01) |
| ***A47B 21/03*** | (2006.01) |

(52) U.S. Cl.

CPC ..... *A47B 9/08* (2013.01); *A47B 21/02* (2013.01); *A47B 21/0314* (2013.01); *A47B 2021/0364* (2013.01); *A47B 2200/004* (2013.01); *A47B 2200/008* (2013.01); *A47B 2200/0062* (2013.01); *A47B 2200/0089* (2013.01)

(58) Field of Classification Search

CPC ..... A47B 9/08; A47B 21/02; A47B 21/0314; A47B 2021/0335; A47B 2021/0364; A47B 2200/0062

See application file for complete search history.

(56) References Cited

U.S. PATENT DOCUMENTS

| | | | | |
|---|---|---|---|---|
| 9,918,550 | B1 * | 3/2018 | Taylor | A47B 21/02 |
| 2014/0137773 | A1 * | 5/2014 | Mandel | G06Q 10/109 108/50.11 |
| 2015/0159804 | A1 * | 6/2015 | Bowman | F16M 11/045 248/122.1 |
| 2015/0285430 | A1 * | 10/2015 | Wang | F16M 11/18 248/188.5 |
| 2016/0037907 | A1 * | 2/2016 | Ergun | A47B 9/02 108/147 |
| 2016/0073779 | A1 * | 3/2016 | Ringlein | A47B 21/04 108/28 |
| 2016/0081468 | A1 * | 3/2016 | Molteni | A47B 13/02 108/147 |

(Continued)

*Primary Examiner* — Daniel J Rohrhoff

(74) *Attorney, Agent, or Firm* — Sheridan Ross P.C.

(57) ABSTRACT

Sit-stand desk, such as conversion desks, provide a convenient option for desk work by users who desire the option to selectively sit or stand. Often, the vertical distance between a keyboard and monitor differs when in the sitting configuration versus the standing configuration. A sit-stand desk provided herein allows for a user to transition between a sitting configuration and a standing configuration with a single lifting mechanism with a programmable distance variation between the keyboard and monitor. Accordingly, a user may transition between the sitting configuration and the standing configuration without requiring readjustment of the relative distance between the monitor and keyboard.

13 Claims, 21 Drawing Sheets

(56) References Cited

U.S. PATENT DOCUMENTS

| | | | | |
|---|---|---|---|---|
| 2018/0255920 | A1* | 9/2018 | Currie | A47B 21/02 |
| 2019/0038017 | A1* | 2/2019 | Platzer | A47B 9/20 |
| 2019/0053617 | A1* | 2/2019 | Laudadio | A47B 21/02 |
| 2019/0254420 | A1* | 8/2019 | Rossini | F16M 11/24 |

* cited by examiner

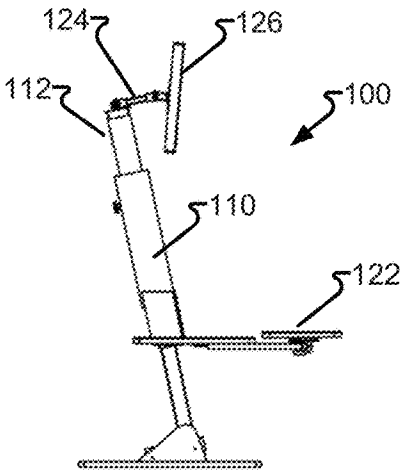
FIG. 6A
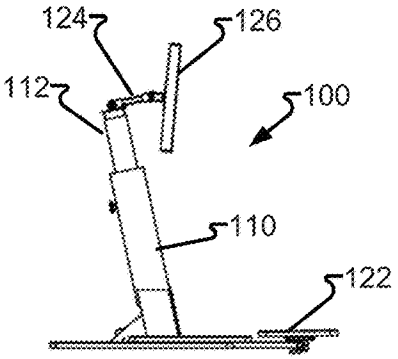
FIG. 6B
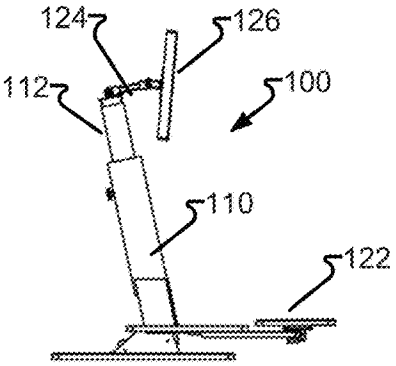
FIG. 6C
FIG. 6D
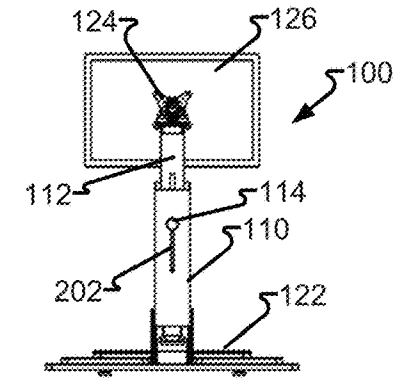
FIG. 7A
FIG. 7B
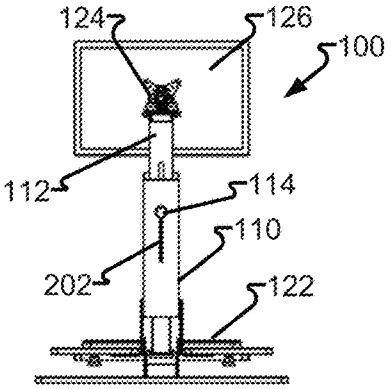
FIG. 7C
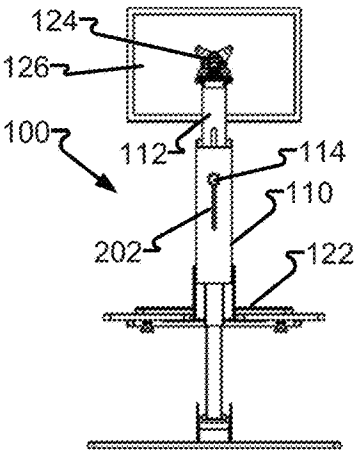
FIG. 7D

POWERED SIT-STAND DESK

CROSS-REFERENCE TO RELATED APPLICATIONS

The present application claims the benefit of U.S. Provisional Patent Application No. 62/590,991, filed on Nov. 27, 2017, and is incorporated herein by reference in its entirety.

COPYRIGHT NOTICE

A portion of the disclosure of this patent document contains material that is subject to copyright protection. The copyright owner has not objected to the facsimile reproduction by anyone of the patent document or the patent disclosure as it appears in the Patent and Trademark Office patent files or records, but otherwise reserves all copyright rights whatsoever.

FIELD OF THE DISCLOSURE

The invention relates generally to systems and methods for furniture and particularly to sit-stand desks configured for use with computer input-output devices.

BACKGROUND

Adjustable height desks, often called "sit-stand desks," or "standing desks" allow a user to utilize computer input/output equipment (e.g., keyboard, mouse, monitor, etc.) while seated or while standing (or while walking, jogging, running, etc.). When a user wishes to change from sitting to standing, or vice versa, a keyboard, mouse, or other input device tray and/or monitor support are then repositioned adjusted to match the user's change in position.

SUMMARY

These and other needs are addressed by the various embodiments and configurations of the present invention.

Prior art solutions may elevate a keyboard tray (which may also accommodate a mouse, trackpad, drawing pad, and/or other input device) and a monitor support. However, the relative distance between a monitor and keyboard is constant between sitting and standing. Most users find such a configuration less the optimal and compromise. For example, they may position their monitor and keyboard to their preferred position while seated and, upon transitioning to standing, position the keyboard to their preferred position, but then either have to manually raise the monitor or utilize the monitor in a non-preferred viewing angle, such as looking down. Accordingly, either the user has to accept the less than ideal configuration for at least one of sitting or standing or readjust the relative height of at least one of the keyboard tray or monitor support each time they transition between sitting and standing. It should be appreciated, that "raise", "up", and similar terms refer to increasing the overall desk height or a portion thereof in the direction of travel away from the ground or supporting surface when the desk is placed thereon for use by a user and "lower," "down," and similar terms refer to decreasing the overall desk height or a portion thereof in the direction of travel toward the ground or supporting surface when the desk is placed thereon for use by a user. Additionally or alternatively, the single monitor/monitor support provided herein does not preclude other embodiments, wherein two or more monitors are utilized and/or physical document holders, or other workpieces where maintaining such workpiece at eye level, whether sitting or standing, while engaged with a sit-stand desk, is desirable.

The present invention can provide a number of advantages depending on the particular configuration. In particular, one advantage is the convenience and consistency of having, after a one-time initial configuration, a single button to cause a sit-stand desk to transition to a standing-use configuration, and present a monitor and keyboard at the user's preferred height for standing use and then present the monitor and keyboard at the user's preferred height for seated use—without requiring any subsequent adjustment or additional motors. Embodiments may include a human can apply the lifting force, such as by grabbing a keyboard support and disengaging any latching mechanism, lifting the keyboard support that also lifts the monitor support, without departing from the scope of the embodiments.

The term "sit-stand desk," as used herein, refers to a sit-stand adjustable height work structure which may support or have attach thereto one or more input/output computing devices, papers, books, and/or other objects for which a preferred viewing angle and/or hand/arm position may be varied, such as to accommodate use by a user while seated and while standing, which may also include, walking, running, jogging, etc. Additionally, embodiments of the sit-stand may include a "conversion" desk, such as to be supported or attached to a desk or other table-like surface. Other embodiments, may be freestanding, such as when the sit-stand desk is placed on the floor and comprises legs or other supports.

It should be appreciated that while embodiments of the present disclosure may be described with respect to "sit," "sitting," "stand," or "standing," or similar words that identify a particular position or activity that a user of a desk may be engaged in while utilizing the desk or components thereof, the user and their position are non-limiting. Such terminology is merely a more readily understood convention as compared to terminology that would otherwise be required to describe a particular configuration of a sit-stand desk that did not reference a human user or an activity or position of such a human user. For example, while it may be commonplace for users of standing desks to have the desk (e.g., keyboard tray, monitor support, etc.) in a lower configuration, such as to accommodate use while seated, and a higher configuration, such as to accommodate use while standing, walking, jogging, running, etc., the embodiments herein may accommodate a user sitting or standing, but may also accommodate a user that merely wishes to have variations in the height of a monitor or other display and/or keyboard while they maintain their activity or position. Therefore, it should be understood that the sit-stand desk, when configured for use while seated, is configured to have at least one of a monitor support, keyboard support, and/or other user interface device in a lower configuration (e.g., closer to the floor, closer to the surface supporting the sit-stand desk, etc.) as compared to a higher configuration, which may be referred to as being configured for use while standing, walking, etc.

These and other advantages will be apparent from the disclosure of the invention(s) contained herein.

Embodiments described and illustrated in the figures are primarily directed to sit-stand desk converters (e.g., a device placed on, or mounted to, a desk surface), however, it should be appreciated that certain embodiments herein may be applied to sit-stand desks (e.g., wherein the desk surface is a component of the powered sit-stand desk, which may be freestanding), without departing from the scope of the embodiments provided herein.

In one embodiment, an adjustable-height computer desk is disclosed, comprising: a base; a telescoping column, wherein the telescoping column comprises a first column attached to the base, a second column slidably attached to the first column, and a third column slidably attached to the second column; and a lifting mechanism, wherein a lifting force applied to one of the second column or the third column differentially lifts both the second column and the third column.

In another embodiment, a method is disclosed for supporting multiple devices for interaction with a user, comprising: providing a keyboard support configured to support a computer input device for receiving manual inputs from a user; providing a monitor support configured to support a computer display device for presenting visual information to the user; providing the keyboard support and monitor support in a first position configured to accommodate the user performing at least one of providing inputs to the computer input device or receiving visual information from the computer display while seated, and having a first difference between the keyboard support and the monitor support; and providing the keyboard support and monitor support in a second position configured to accommodate the user performing at least one of providing inputs to the computer input device or receiving visual information from the computer display while standing, and having a second difference between the keyboard support and the monitor support, and wherein the first distance is different from the second distance; and wherein the keyboard support and monitor support move from the first position to the second position via a single lifting force applied to one of the keyboard support or the monitor support.

In another embodiment, an adjustable-height computer desk, comprising: a base for supporting the adjustable-height desk; a telescoping column, wherein the telescoping column comprises a first column attached to the base, a second column slidably attached to the first column, and a third column slidably attached to the second column; a keyboard support configured to support a computer input device for receiving manual inputs from a user and attached to the second column; a monitor support configured to support a computer display device for presenting visual information to the user attached to the third column; a lifting mechanism, wherein a lifting force applied to one of the second column or the third column differentially lifts both the second column and the third column to cause the keyboard support and monitor support to move from the first position toward the second position; and wherein the keyboard support and monitor support, when in a second position, have a second height differential different from the first height differential.

The phrases "at least one," "one or more," "or," and "and/or" are open-ended expressions that are both conjunctive and disjunctive in operation. For example, each of the expressions "at least one of A, B, and C," "at least one of A, B, or C," "one or more of A, B, and C," "one or more of A, B, or C," "A, B, and/or C," and "A, B, or C" means A alone, B alone, C alone, A and B together, A and C together, B and C together, or A, B, and C together.

The term "a" or "an" entity refers to one or more of that entity. As such, the terms "a" (or "an"), "one or more," and "at least one" can be used interchangeably herein. It is also to be noted that the terms "comprising," "including," and "having" can be used interchangeably.

The term "automatic" and variations thereof, as used herein, refers to any process or operation, which is typically continuous or semi-continuous, done without material human input when the process or operation is performed. However, a process or operation can be automatic, even though performance of the process or operation uses material or immaterial human input, if the input is received before performance of the process or operation. Human input is deemed to be material if such input influences how the process or operation will be performed. Human input that consents to the performance of the process or operation is not deemed to be "material."

Aspects of the present disclosure may take the form of an embodiment that is entirely hardware, an embodiment that is entirely software (including firmware, resident software, micro-code, etc.) or an embodiment combining software and hardware aspects that may all generally be referred to herein as a "circuit," "module," or "system." Any combination of one or more computer-readable medium(s) may be utilized. The computer-readable medium may be a computer-readable signal medium or a computer-readable storage medium.

A computer-readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer-readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer-readable storage medium may be any tangible medium that can contain or store a program for use by or in connection with an instruction execution system, apparatus, or device.

A computer-readable signal medium may include a propagated data signal with computer-readable program code embodied therein, for example, in baseband or as part of a carrier wave. Such a propagated signal may take any of a variety of forms, including, but not limited to, electromagnetic, optical, or any suitable combination thereof. A computer-readable signal medium may be any computer-readable medium that is not a computer-readable storage medium and that can communicate, propagate, or transport a program for use by or in connection with an instruction execution system, apparatus, or device. Program code embodied on a computer-readable medium may be transmitted using any appropriate medium, including, but not limited to, wireless, wireline, optical fiber cable, RF, etc., or any suitable combination of the foregoing.

The terms "determine," "calculate," "compute," and variations thereof, as used herein, are used interchangeably and include any type of methodology, process, mathematical operation or technique.

The term "means" as used herein shall be given its broadest possible interpretation in accordance with 35 U.S.C., Section 112(f) and/or Section 112, Paragraph 6. Accordingly, a claim incorporating the term "means" shall cover all structures, materials, or acts set forth herein, and all of the equivalents thereof. Further, the structures, materials or acts and the equivalents thereof shall include all those described in the summary, brief description of the drawings, detailed description, abstract, and claims themselves.

The preceding is a simplified summary of the invention to provide an understanding of some aspects of the invention. This summary is neither an extensive nor exhaustive overview of the invention and its various embodiments. It is intended neither to identify key or critical elements of the invention nor to delineate the scope of the invention but to present selected concepts of the invention in a simplified form as an introduction to the more detailed description presented below. As will be appreciated, other embodiments of the invention are possible utilizing, alone or in combination, one or more of the features set forth above or described in detail below. Also, while the disclosure is presented in terms of exemplary embodiments, it should be appreciated that an individual aspect of the disclosure can be separately claimed.

BRIEF DESCRIPTION OF THE DRAWINGS

The present disclosure is described in conjunction with the appended figures:

FIGS. 6A-D depict a side view of a first transition of a sit-stand desk from a sitting configuration to a standing configuration, in accordance with embodiments of the present disclosure;

FIGS. 7A-D depict a rear view of a first transition of a sit-stand desk from a sitting configuration to a standing configuration, in accordance with embodiments of the present disclosure;

DETAILED DESCRIPTION

The ensuing description provides embodiments only and is not intended to limit the scope, applicability, or configuration of the claims. Rather, the ensuing description will provide those skilled in the art with an enabling description for implementing the embodiments. It will be understood that various changes may be made in the function and arrangement of elements without departing from the spirit and scope of the appended claims.

Any reference in the description comprising an element number, without a subelement identifier when a subelement identifier exists in the figures, when used in the plural, is intended to reference any two or more elements with a like element number. When such a reference is made in the singular form, it is intended to reference one of the elements with the like element number without limitation to a specific one of the elements. Any explicit usage herein to the contrary or providing further qualification or identification shall take precedence.

The exemplary systems and methods of this disclosure will also be described in relation to a lifting mechanism to transition, and maintaining, a sit-stand desk between one configuration, suitable for use while sitting, and a second configuration, suitable for use while standing and/or walking, running, jogging, etc. However, to avoid unnecessarily obscuring the present disclosure, the following description omits well-known structures, components, and devices that may be shown in block diagram form and are well known or are otherwise summarized.

For purposes of explanation, numerous details are set forth in order to provide a thorough understanding of the present disclosure. It should be appreciated, however, that the present disclosure may be practiced in a variety of ways beyond the specific details set forth herein.

The present invention, in various embodiments, configurations, and aspects, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, configurations, and aspects, includes providing devices and processes in the absence of items not depicted and/or described herein or in various embodiments, configurations, or aspects hereof, including in the absence of such items as may have been used in previous devices or processes (e.g., for improving performance, achieving ease, and\or reducing cost of implementation).

Figure 1:
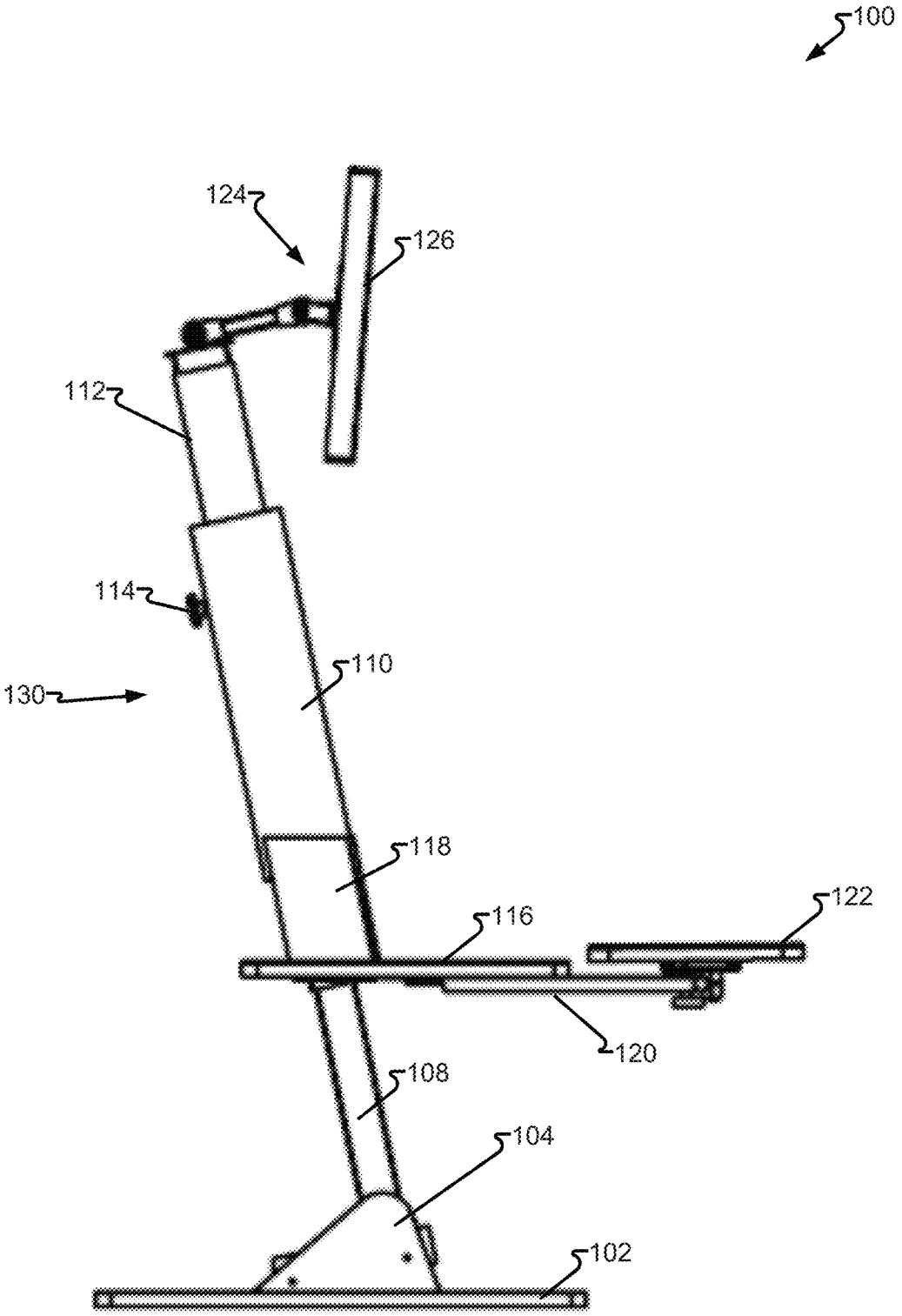
FIG. 1 depicts a sit-stand desk in accordance with embodiments of the present disclosure.

FIG. 1 depicts sit-stand desk 100 in accordance with embodiments of the present disclosure. In one embodiment, sit-stand desk 100 comprises base 102, telescoping column 130, and base bracket 104 connecting column 130 to base 102. Telescoping column 130 may comprise first column 108 attached to base bracket 104, and second column 110 and third column 112. Work surface 116 may comprise keyboard support structure 120 and keyboard support 122 attached thereto. Monitor 126 may be attached to monitor support 124 which is further attached to second column 112. Second column 112, third column 110 and first column 108 may be coaxially aligned, arranged with at least two of first column 108, second column 110, and third column 112 in parallel side-by-side. Telescoping column 130 may further form an angle with base 102, such as may be determined by based bracket 104. The angle may be selected such as to enable the varying position of monitor 126 and/or keyboard support 122 to provide a varying distance from a user between a sitting configuration and a standing configuration. For example, the angle may be 15° or other angle as may be provided as a matter of design choice, such as to move monitor 126 away from a user when raised as compared to when lowered. As a benefit, users often prefer to sit closer to a monitor than standing, such as to accommodate increased head motion while standing, walking, etc. The distance between the user and a keyboard, on keyboard support 122, can readily be adjusted by the user sitting or standing closer to keyboard support 122.

In another embodiment, first column 108 and third column 112 may contain and/or comprise a linear motor or other actuator or portions thereof. For example, an electrical supply to a linear motor may cause first column 108 and third column 112 to extend relative to each other and thereby apply a lifting force to third column 112 and/or second column 110. In yet another embodiment, springs with a power supplied (e.g., linear motor), and/or manual support may provide the lifting force.

Figure 2A:
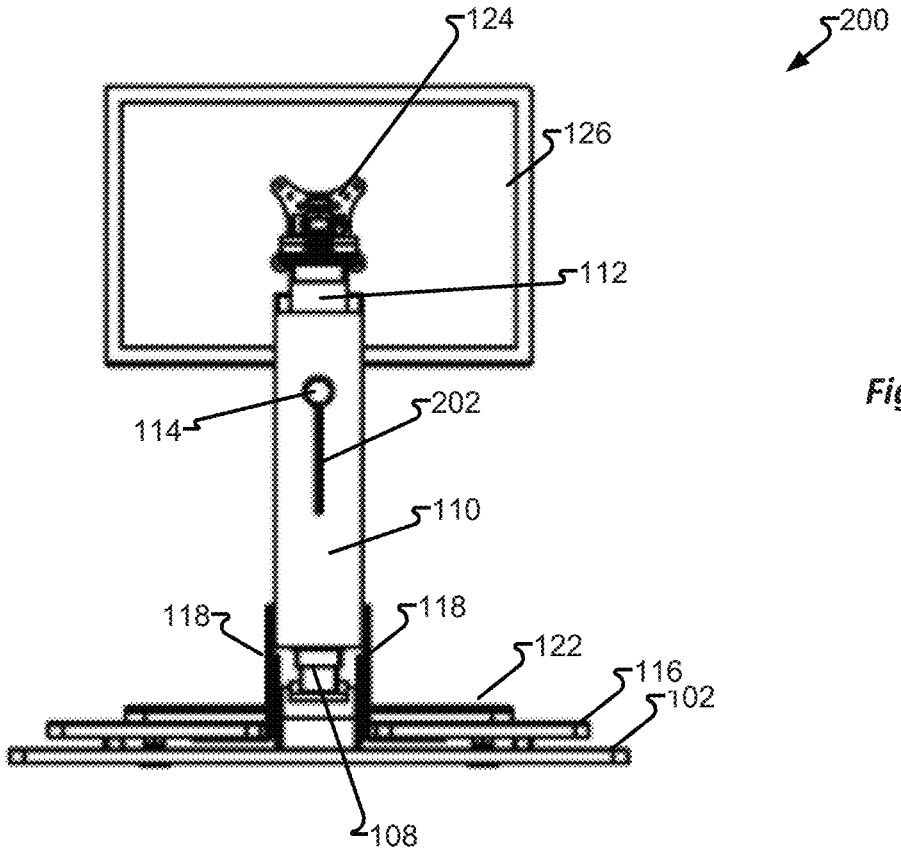
FIGS. 2A-B depict a sit-stand desk, in a first position, in accordance with embodiments of the present disclosure.
Figure 2B:
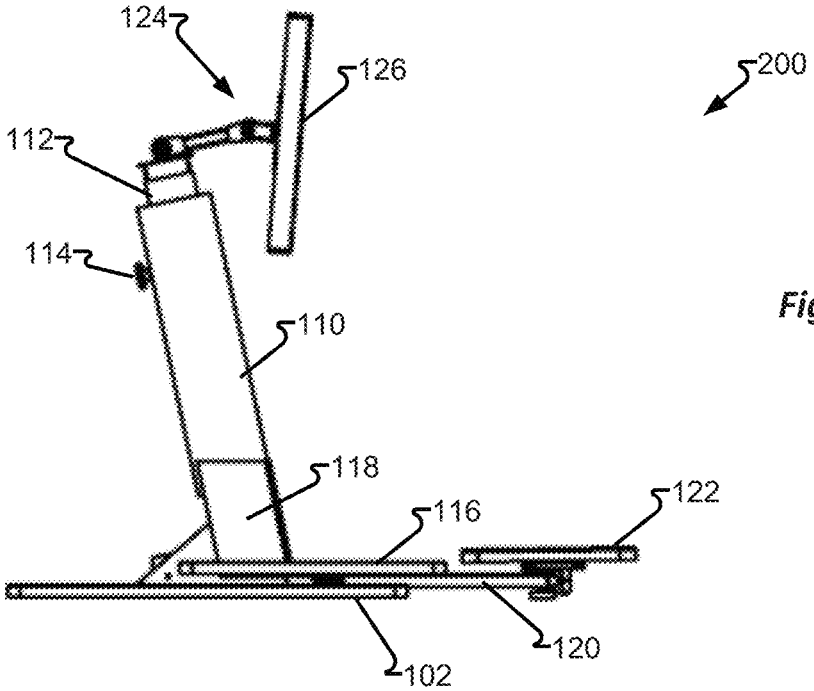

FIGS. 2A-B each depict sit-stand desk 100, in first position 200, in accordance with embodiments of the present disclosure. In one embodiment, FIG. 2A depicts sit-stand desk 100 in a rear view and FIG. 2B depicts sit-stand desk 100 in a side view. Monitor support 124 accommodates monitor 126 for attachment thereto which, in turn, is attached to third column 112 adjustment knob 114 is disposed within slot 202 of second column 110 which is attached to work surface bracket 118. Base 102, work surface 116, and keyboard support 122 are in a lowered configuration. It should be appreciated that slot 202 may comprise a series of holes. Additionally or alternatively, slot 202 and adjustment knob 114 may be embodied as a series of engageable tabs or other structure whereby travel of a component (e.g., third column 112) may be independent of second column 110, for a first portion of travel, and thereafter, in a second portion of travel, travel of the component tied to the travel of second column 110—and vice versa when lowing sit-stand desk 200.

An adjustable stop may be embodied as knob 114, as illustrated in FIG. 2A, is disposed at or very near the top of slot 202. As will be described in more detail with the embodiments that follow, the placement of knob 114 along slot 202 determines a relative height of monitor support 124 and as a result monitor 126 as sit-stand desk 100 is configured for standing use.

In another embodiment, first column 108 comprises, is comprised by, or incorporates an actuator. The actuator may be a linear motor, rotational motor with a chain/cable and pulleys, pneumatic, and/or hydraulic actuator. It should be appreciated that while pneumatic actuators may be utilized without departing from the scope of the embodiments, the bounce that may occur with pneumatic, and the supporting infrastructure associated with hydraulics (e.g., pump, reservoirs, filters, etc.) are generally disfavored in view of linear motors and other sources of force which may be more stable and, therefore, preferred as a support for keyboards and/or monitors. However, stabilizing means (e.g., latches, catches, friction knobs, etc.) may be utilized to restrict motion that may be otherwise present, such as due embodiments utilizing pneumatic actuators. In yet another embodiment, the arrangement of first column 108, second column 110, and 112 may be varied, such as to mount monitor support 124 to first column 108 and/or third column 112 to base bracket 104.

Figure 3A:
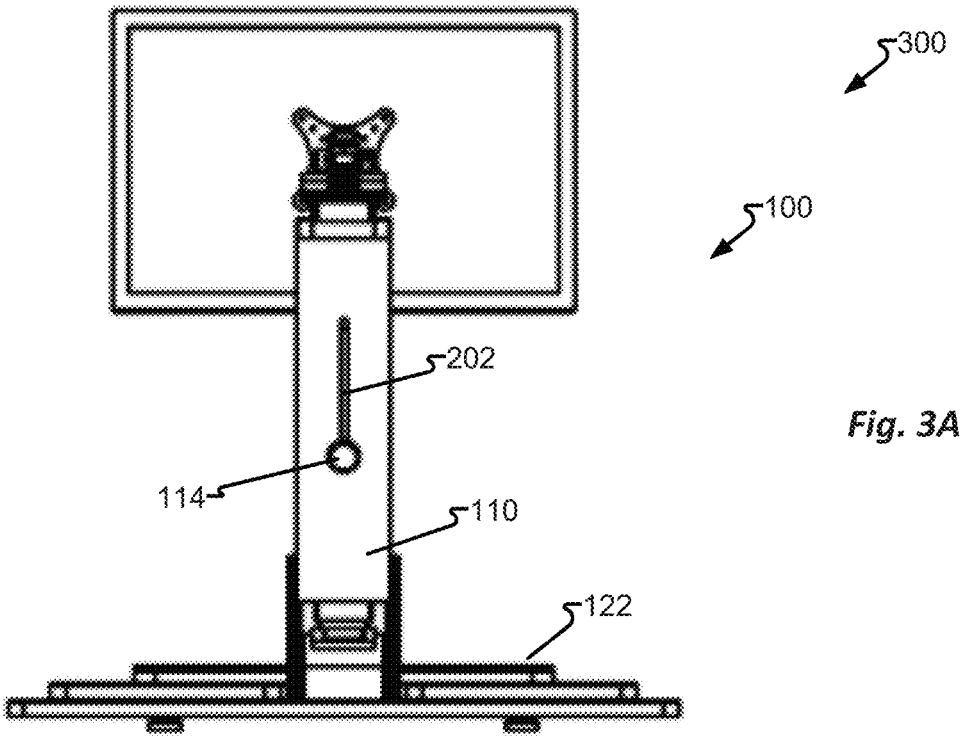
FIGS. 3A-B depict a sit-stand desk, in a second position, in accordance with embodiments of the present disclosure.
Figure 3B:
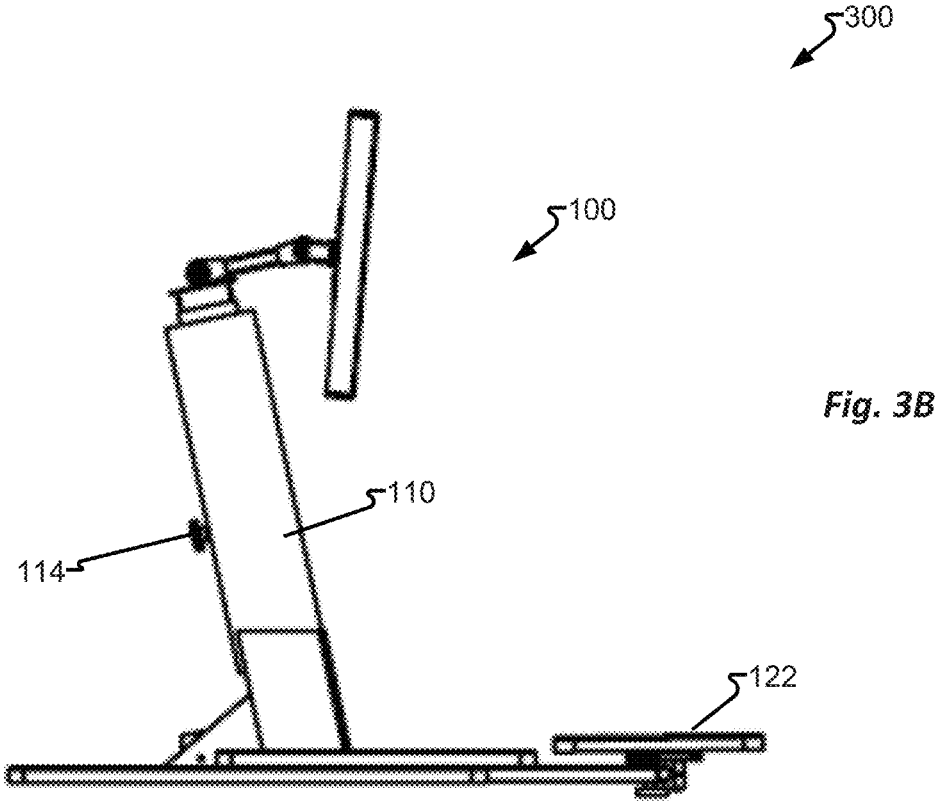

FIGS. 3A-B depict sit-stand desk 100, in second position 300, in accordance with embodiments of the present disclosure. In one embodiment, knob 114 is located at the bottom of slot 202 in second column 110. As will be discussed more completely in the embodiments that follow, the placement of knob 114 may then determine the height of keyboard support 122.

Figure 4:
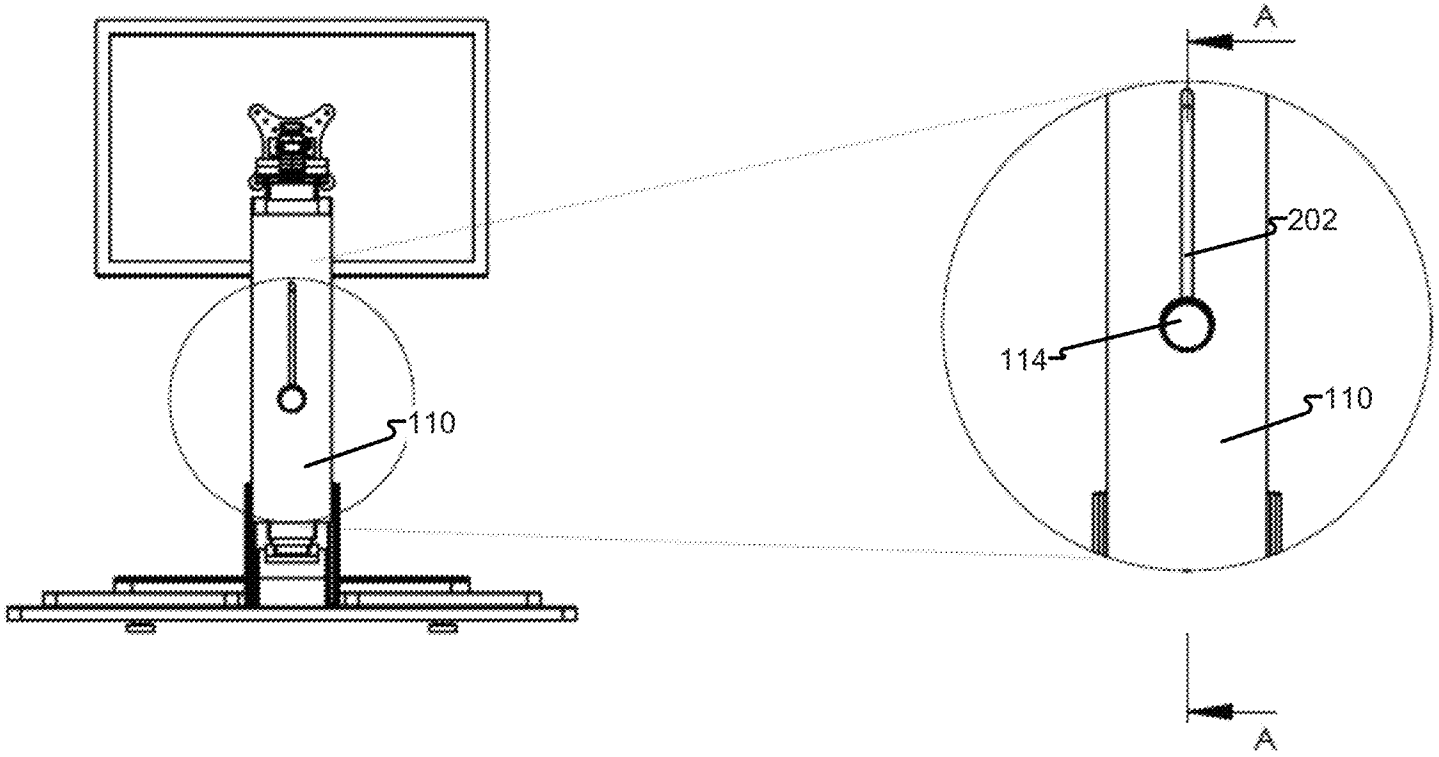
FIG. 4 depicts a sit-stand desk with an enhanced view of a height adjustment mechanism, in accordance with embodiments of the present disclosure.

FIG. 4 depicts sit-stand desk 100 with an enhanced view of a height adjustment mechanism. In one embodiment, knob 114 is disposed with slot 202 in second column 110 and selectively attaches third column 112 to first column 108 and may additionally limit the height difference between third column 112, with attached monitor support 124, and second column 110, with attached keyboard support 122.

Figure 5:
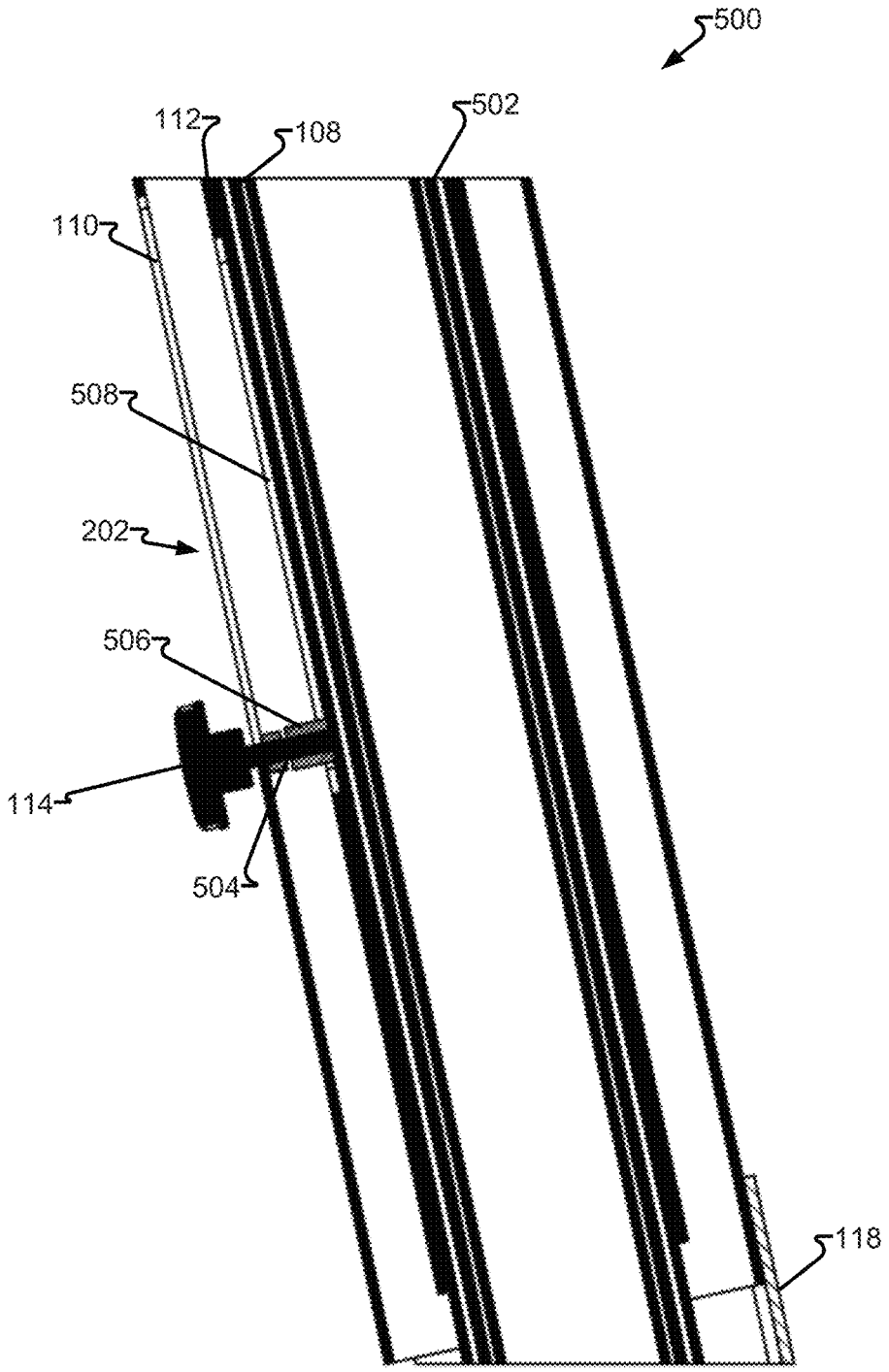
FIG. 5 depicts a sectional view of a portion of a sit-stand desk showing a height adjustment mechanism, in accordance with embodiments of the present disclosure.

FIG. 5 depicts sectional view 500 of a portion of a sit-stand desk 100 showing a height adjustment mechanism. In one embodiment, knob 114 comprises threaded member 504 engaging threaded tube 506 to selectively apply a force to cause third column 112 to be selectively attached to a portion of slot 508 in third column 112. Second column 110 comprises slot 202 which allows knob 114 to move freely within slot 202 but engaged at the limit of relative travel when knob 114 reaches the extend to slot 202. Third column 112 may comprise slot 508 and enable knob 114 to be positioned at a location within slot 202, which will be described more completely with respect to FIGS. 16A-B. Additionally or alternatively, guidance portion 502 may provide additional stability to sit-stand desk 100.

FIGS. 6A-D depict side views of a first transition of a sit-stand desk 100 from a sitting configuration to a standing configuration. In one embodiment, FIG. 6A illustrates sit-stand desk 100 at a lowest configuration, which may be suitable for use (e.g., typing on a keyboard located on keyboard support 122, observing visual content presented on monitor 126, etc.) while a user is seated, FIG. 6B illustrates sit-stand desk 100 at a first intermediate configuration, whereby third column 112 and attached monitor support 124 and monitor 126 have been elevated but keyboard support 122 remains unmoved. FIG. 6C illustrates sit-stand desk 100 at a second intermediate configuration, whereby third column 112, and attached monitor support 124 and monitor 126, as well as second column 110 and attached keyboard support 122 have been elevated. FIG. 6D illustrates sit-stand desk 100 at an extended configuration, whereby third column 112, and attached monitor support 124 and monitor 126, as well as second column 110 and attached keyboard support 122 have been elevated further and may be at the limit of their extension.

FIGS. 7A-D depict a rear view of a first transition of a sit-stand desk 100 from a sitting configuration to a standing configuration. In one embodiment, FIG. 7A is a rear view of FIG. 6A, FIG. 7B is a rear view of FIG. 6B, FIG. 7C is a rear view of FIG. 6C, and FIG. 7D is a rear view of FIG. 6D. FIG. 7A illustrates sit stand desk at a lowest configuration. In one embodiment, knob 114 is disposed at the bottom of slot 202. FIG. 7B illustrates third column being lifted such that knob 114 engages second column 110 at the extent of slot 202, after which, continued elevation of third column 112 results in second column 110 being elevated and, thereby raising keyboard support 122, as illustrated in FIG. 7C. FIG. 7D illustrates sit-stand desk 100 in the extended configuration.

It should be appreciated that the lowest position of sit-stand desk 100 may be determined by the surface supporting sit-stand desk 100. Additionally, keyboard support 122 may be embodied as a dropped keyboard tray, such that keyboard support 122 may be extended below the supporting surface of sit-stand desk 100, without departing from the embodiments disclosed.

Figure 8A:
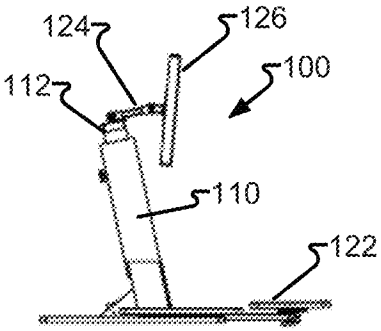
FIGS. 8A-C depict a side view of a second transition of a sit-stand desk from a sitting configuration to a standing configuration, in accordance with embodiments of the present disclosure.
Figure 8B:
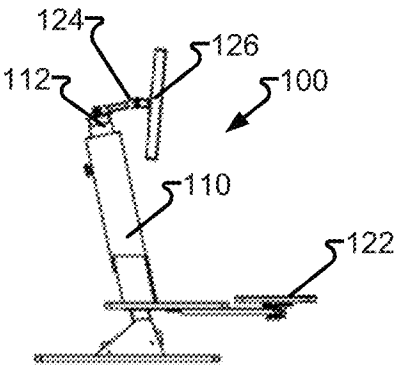
Figure 8C:
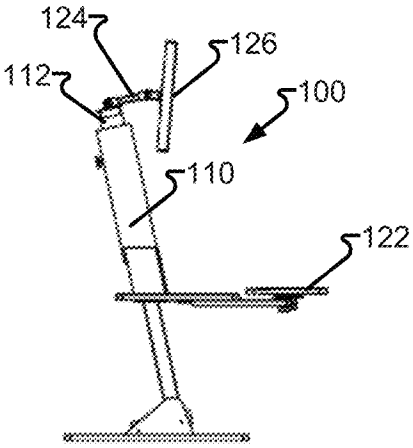

FIGS. 8A-C depict side views of a second transition of a sit-stand desk 100 from a sitting configuration to a standing configuration. In one embodiment, FIG. 8A illustrates sit-stand desk 100 at a lowest configuration, which may be suitable for use while a user is seated, FIG. 8B illustrates sit-stand desk 100 at a first intermediate configuration, whereby third column 112 and attached monitor support 124 and monitor 126 have been elevated but keyboard support 122 remains unmoved. FIG. 8C illustrates sit-stand desk 100 at an extended configuration, whereby third column 112, and attached monitor support 124 and monitor 126, as well as second column 110 and attached keyboard support 122 have been elevated further and may be at the limit of their extension.

Figure 9A:
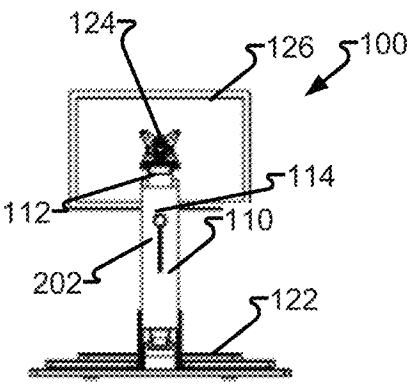
FIGS. 9A-C depict a rear view of a second transition of a sit-stand desk from a sitting configuration to a standing configuration, in accordance with embodiments of the present disclosure.
Figure 9B:
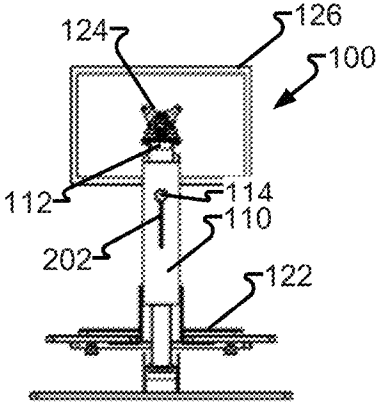
Figure 9C:
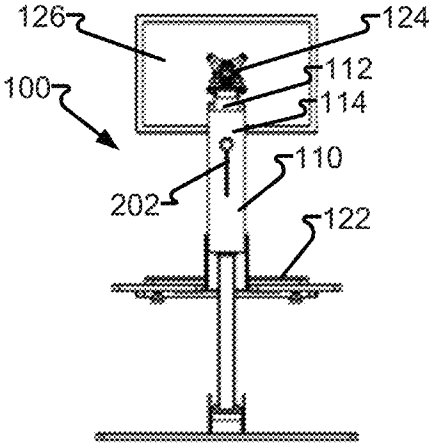

FIGS. 9A-C depict a rear view of a first transition of a sit-stand desk 100 from a sitting configuration to a standing configuration. In one embodiment, FIG. 9A is a rear view of FIG. 8A, FIG. 9B is a rear view of FIG. 8B, and FIG. 9C is a rear view of FIG. 8C. FIG. 9A illustrates sit stand desk at a lowest configuration. In one embodiment, knob 114 is disposed at the top of slot 202. FIG. 9B illustrates third column being lifted such that knob 114 engages second column 110 at the extent of slot 202, after which, continued elevation of third column 112 results in second column 110 being elevated and, thereby raising keyboard support 122, as illustrated in FIG. 9C. FIG. 9D illustrates sit-stand desk 100 in the extended configuration.

In one embodiment, FIGS. 6D and 7D differ from FIGS. 8C and 9C in the height of third column 112 and attached monitor 126 inter alia. A determination of such a difference in height, in one embodiment, is the initial position of knob 114 within slot 202, as illustrated in FIGS. 6A and 7A (bottom) in comparison to FIGS. 8A and 9A (top). In another embodiment, the initial position of knob 114 is between the top and bottom configurations to provide a range of final height positions of third column 112 and attached monitor 126, inter alia.

Figure 10:
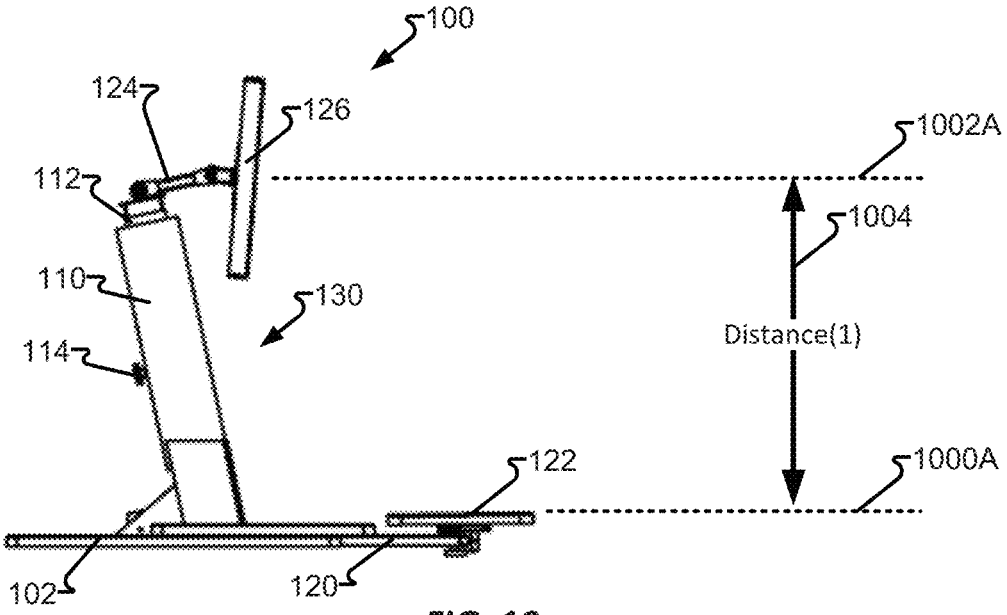
FIG. 10 depict a first configuration of a sit-stand desk, in accordance with embodiments of the present disclosure.

FIG. 10 depict a first configuration of sit-stand desk 100. FIG. 10 illustrates sit-stand desk 100 as configured for use by a seated user. In one embodiment, keyboard height 1000A is determined by configuration of keyboard support 122. As discussed above, sit-stand desk 100 may utilize keyboard support 122 as a lowered keyboard support, such as when keyboard support structure 122 enables keyboard support 122 to be lowered below the surface supporting sit-stand desk 100 without departing form the embodiments disclosed. However, to avoid unnecessarily complicating the figures and description, keyboard support 122 shall be discussed, with respect to being lowered to its lowest position, as illustrated in FIG. 10.

In another embodiment, base monitor height 1002A is determined by telescoping column 130 being in its lowest configuration. It should be appreciated that the height of monitor 126 may be determined, at least in part, by the dimensions of monitor 126, and the configuration of monitor support 124. However, to avoid unnecessarily complicating the figures and description, the height of monitor 126 will be considered constant, but for the configuration of telescoping column 130 and more specifically to the configuration of one or more of components thereof (e.g., first column 108, second column 110, and third column 112). To further maintain consistency monitor height 1002 will be with reference to a consistent point such as a vertical midpoint of monitor 126. Therefore, first distance 1004 is the distance between keyboard height 1000A and monitor height 1002A.

Figure 11:
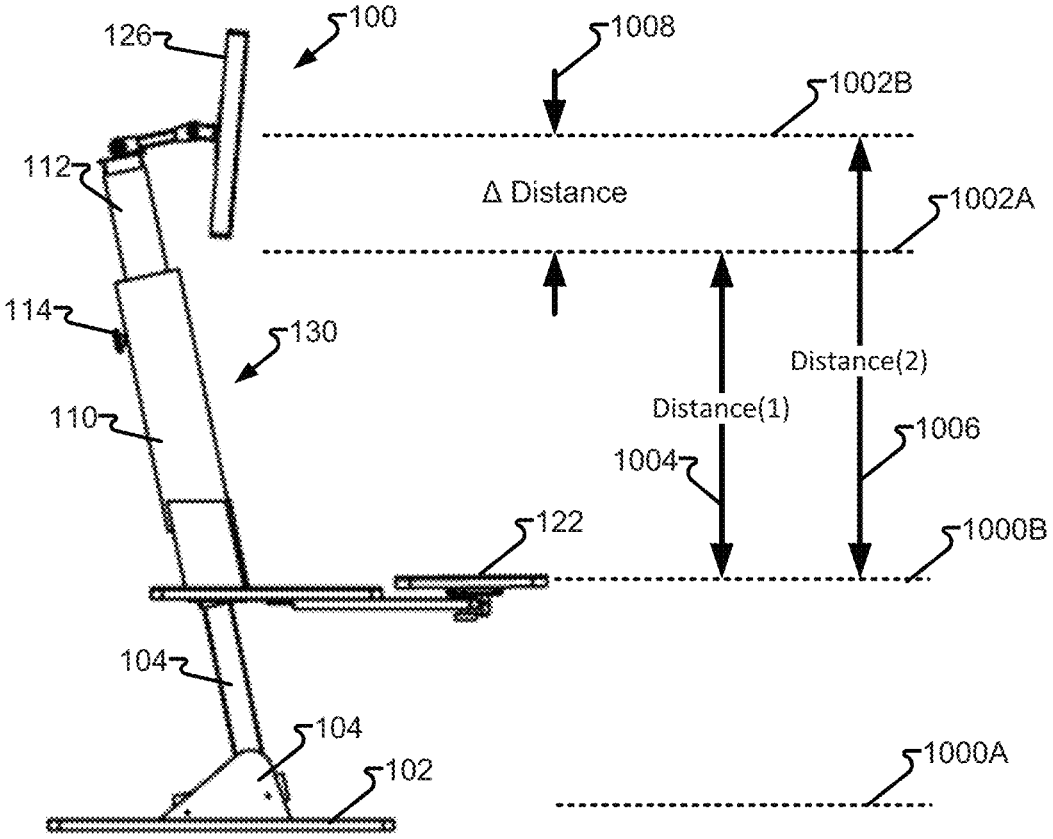
FIG. 11 depicts a second configuration of a sit-stand desk, in accordance with embodiments of the present disclosure.

FIG. 11 depicts a second configuration of sit-stand desk 100, such as when configured for use by a standing user. Monitor 126 is located at height 1002B from keyboard height 1000B, which has also been elevated. In one embodiment, telescoping column 130 is extended to differentially elevate monitor to monitor height 1002B from 1002A and keyboard support 122 from keyboard height 1000A to 1000B, such that the difference between distance (1) 1004 and distance (2) 1006 is no-zero, as illustrated by a height or distance differential, delta-distance 1008. It should be appreciated that delta-distance 1008, is results from a single force application resulting in an extension operation of telescoping column 130 and does not require any other adjustment or alteration to sit-stand desk 100.

Figure 16A:
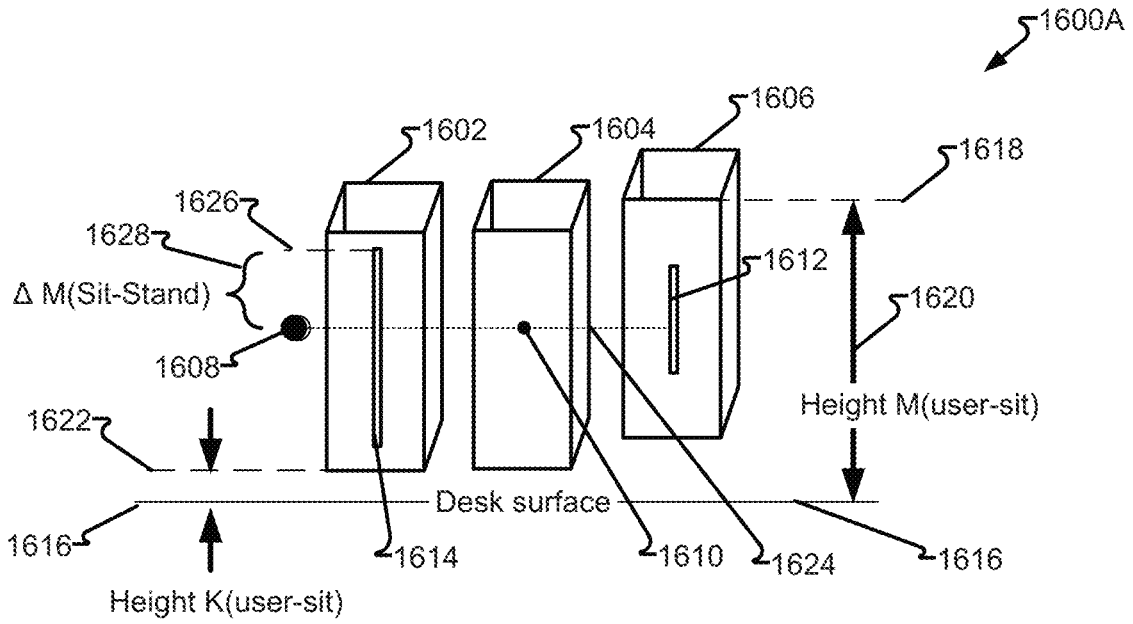
FIGS. 16A-B depict an exploded view of portions of a support structure for a sit-stand desk, in accordance with embodiments of the present disclosure.
Figure 16B:
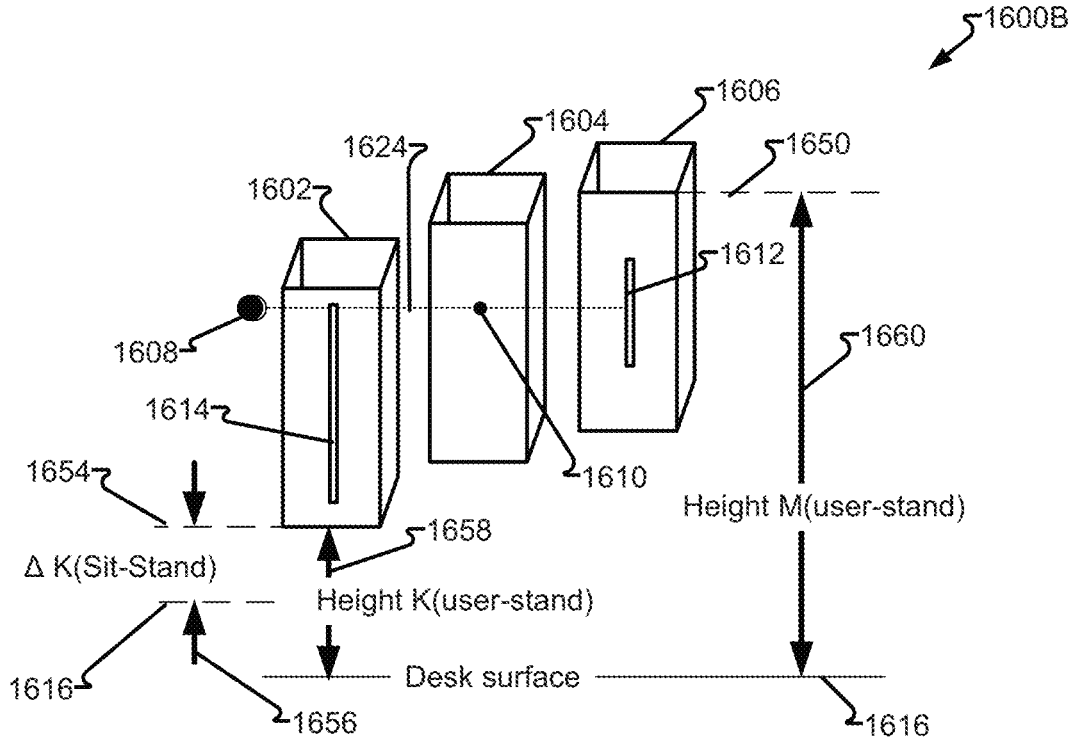

In another embodiment, monitor height 1002B may be "programmed," such as to accommodate a user's preference for use while standing, via placement of knob 114 within slot 202 (see, FIGS. 16A-B).

Figure 12:
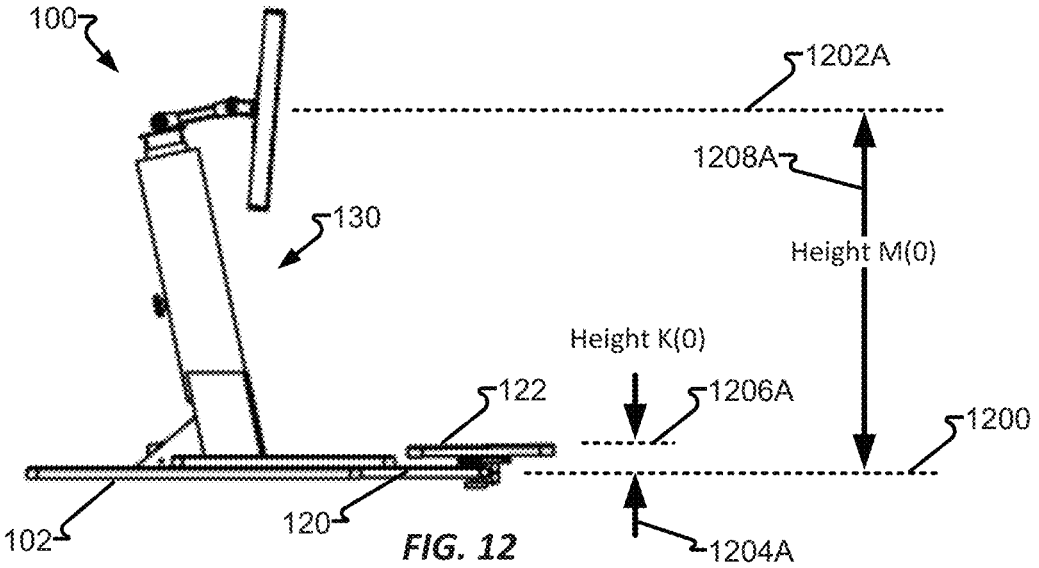
FIG. 12 depicts a sit-stand desk as configured in a lowered position such as for use while seated, in accordance with embodiments of the present disclosure.

FIG. 12 depicts sit-stand desk 100 in a lowered position. In one embodiment, keyboard distance 1204A is a distance from surface engagement position 1200, of base 102, to keyboard tray height 1206A, which may be defined as the surface of keyboard support 122, upon which a keyboard, mouse, or other device may be placed or maintained for use thereon. Monitor height 1202A may be determined as distance 1208A between surface engagement position 1200 to monitor height 1202A. Keyboard distance 1204A may be determined, at least in part, by keyboard support structure 120 and may be lowered or raised relative to surface engagement position 1200.

Figure 13:
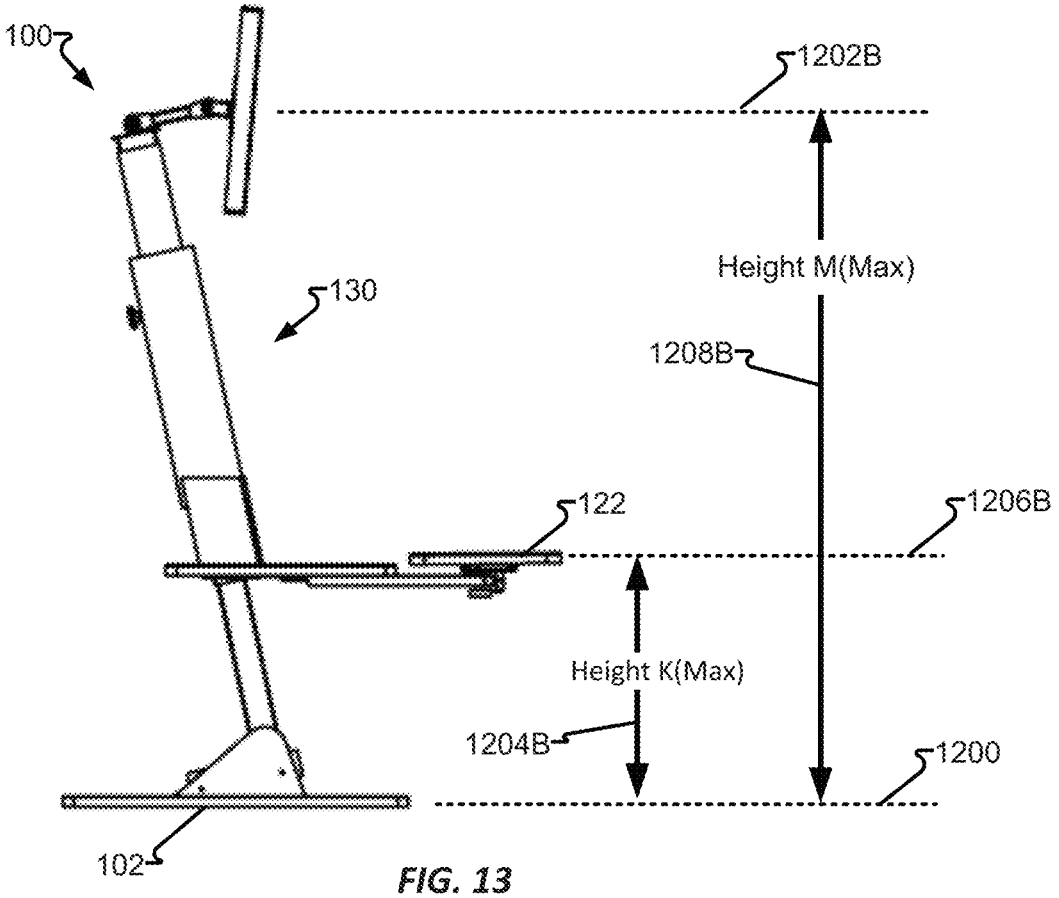
FIG. 13 depicts a sit-stand desk as configured in a raised position, such as for use while standing, in accordance with embodiments of the present disclosure.

FIG. 13 depicts sit-stand desk 100 in a raised, such as to the extended limit of telescoping column 130. Keyboard height 1204B is determined by keyboard tray level 1206B, monitor height 1202B is determined by monitor height 1208B.

Figure 14:
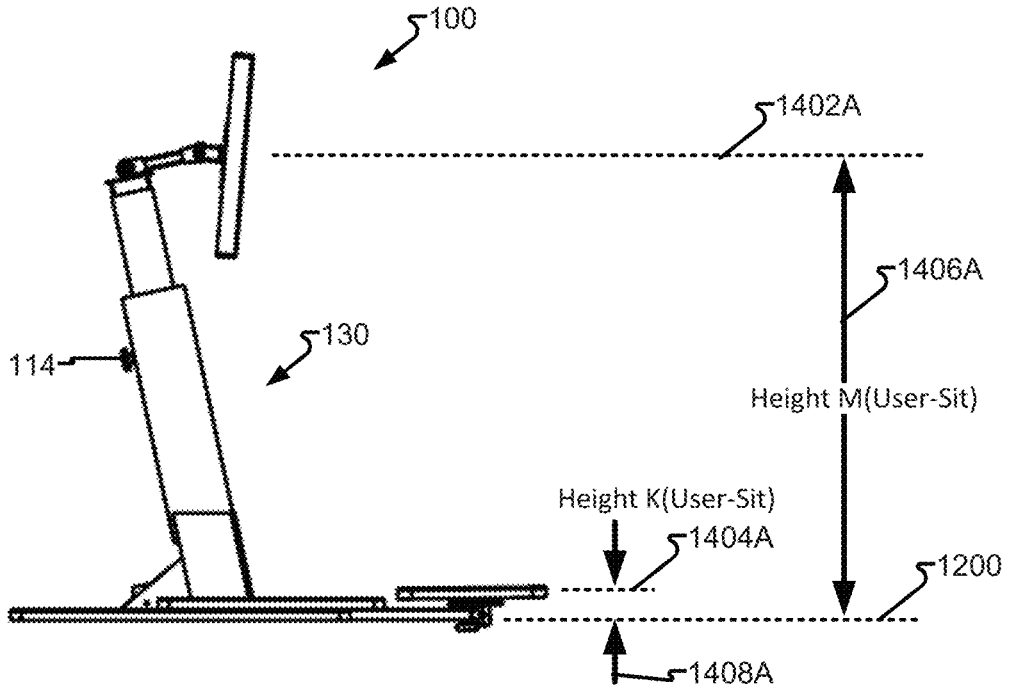
FIG. 14 depicts a sit-stand desk as configured for use while seated with an elevated monitor position, in accordance with embodiments of the present disclosure.

FIG. 14 depicts sit-stand desk 100 as configured, such as for use while seated, and relative distances. Monitor height 1402A is at distance 1406A from engagement position 1200. Keyboard height 1404A is at distance 1408A from engagement position 1200. Due to the relative position of knob 114, distance 1406A is dissimilar to distance 1208A (see, FIG. 12).

Figure 15:
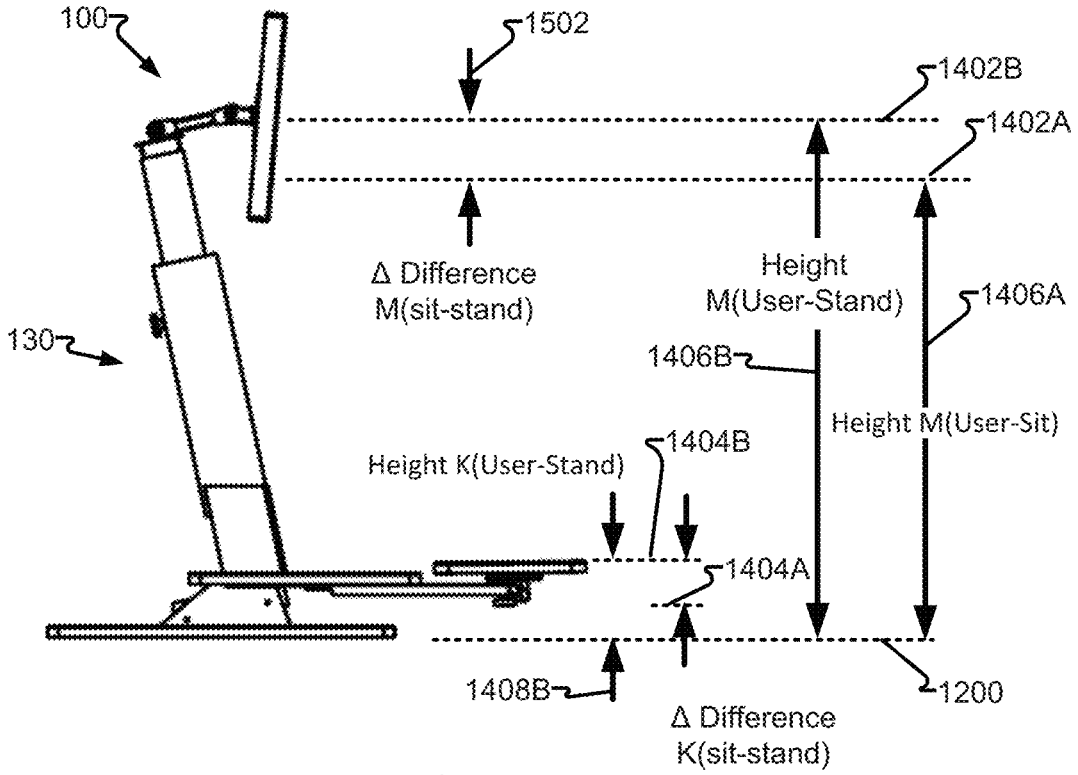
FIG. 15 depicts a sit-stand desk as configured for use while standing, in accordance with embodiments of the present disclosure.

FIG. 15 depicts sit-stand desk 100 as configured for use while sitting, and relative distances. Telescoping column 130 is raised causing a disproportional change in height of keyboard support 122, as measured by distance 1408B, and monitor height 1402B, as measured by monitor height 1406B. The change in monitor height, distance 1406B minus 1406A, being different form the change in keyboard support height, distance 1408B minus 1408A.

FIGS. 16A-B depict embodiments of an exploded view of a portion of sit-stand desk 100 showing support structure 1600. In one embodiment, column 1602 illustrates one embodiment and certain features of second column 110 and column 1606 illustrates one embodiment and certain features of third column 112. FIGS. 16A-B are exploded such that columns 1602 and 1606, when implemented, may be coaxially aligned or otherwise work as a single unit, such as to provide a component of a lifting mechanism, such as telescoping column 130.

In one embodiment, support structure 1600 is in a first configuration, such that knob 1608 physically ties a portion of column 1606 to column 1602 for a one portion of travel, but not another. For example, turning knob 1608 to engage slot 1612 and thereby mechanically link column 1606, at height 1624, such that providing a lifting force to column 1606 will result in the lifting force being applied to column 1602 via a shaft of knob 1608 engaging the limit of slot 1614. Distance 1620 may then be determinate of a monitor height, such as when monitor support 124 is mounted thereto, and when configured for use by a seated user. In another embodiment, distance 1628 is the distance between knob 1608 and limit 1626.

Therefore, support structure 1600A may then determine the height of monitor, when affixed to column 1606, and keyboard support, when affixed to column 1602, when in a lowered position, selected in accordance with a user's preference for seated use. The keyboard support being determined as a distance between desk surface 1616 and lowered keyboard support 1622.

Support structure 1600B illustrates relative positions when in a second configuration. A lifting force (not shown) is applied to column 1606. Upon column 1606 being raised to engage knob 1608 at the limit of slot 1614, column 1602 is then raised by the lifting force.

Therefore, support structure 1600B may then determine the height of monitor, when affixed to column 1606, and keyboard support, when affixed to column 1602, when in a raised position, selected in accordance with a user's preference for standing use. The keyboard support height 1658 may be determined, at least in part, as distance 1658 between desk surface 1616 and raised keyboard support 1654 and comprise distance 1656 as the difference between lowered keyboard support 1622 and raised keyboard support 1654. The monitor height 1650 being distance 1660 as determined by the extent of the lifting force upon column 1606 having a monitor attached thereto and additionally or alternatively, the relative position of column 1606 as attached to column 1606 via knob 1608 and slot 1612.

While columns 1602 and 1606 are illustrated as square tubes, it should be appreciated that round tubes or other structures may be utilized without departing form the scope of the embodiments described.

Figure 17:
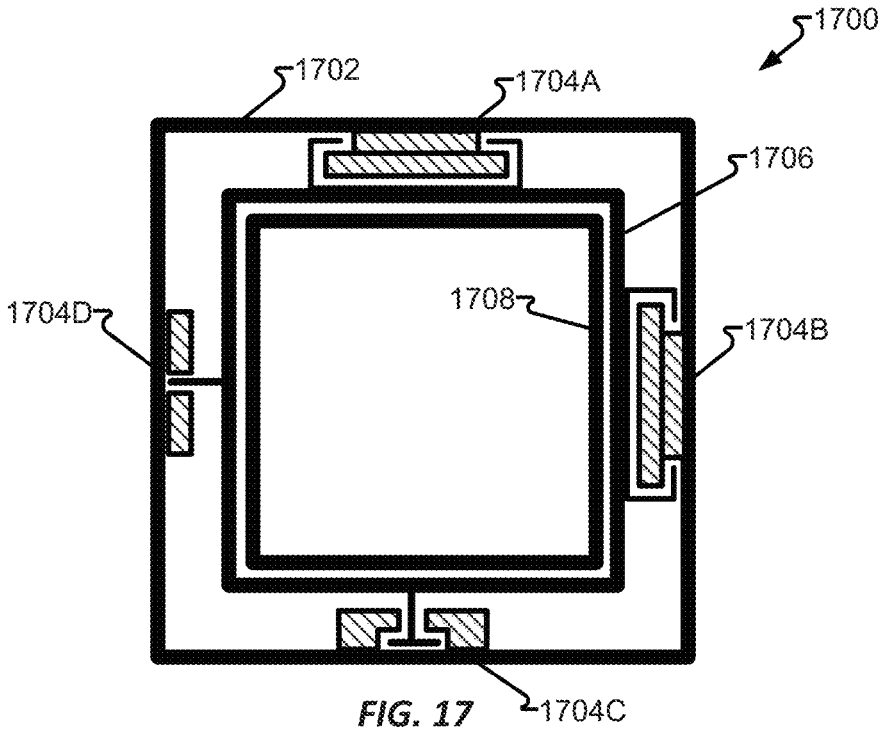
FIG. 17 depicts a cross-sectional view of a first support structure for a sit-stand desk, in accordance with embodiments of the present disclosure.

FIG. 17 depicts cross-sectional view 1700 of a first support structure for a sit-stand desk. In one embodiment, inner column 1708 receives a lifting force and applies the lifting force to middle column 1706. Middle column 1706 receives the lifting force and, via a catch, latch or pin (e.g., knob 114), a selectively applies the lifting force to outer column 1702.

One or more slidable tracks 1704 may be utilized, such as one or more slidable tracks 1704A-D, between any two columns 1708 and 1706 and/or 1706 and 1702. Slidable tracks 1704 may be, or may resemble, drawer slides 1704A-B, "T" track 1704C, and/or slot and grove track 1704D.

Figure 18:
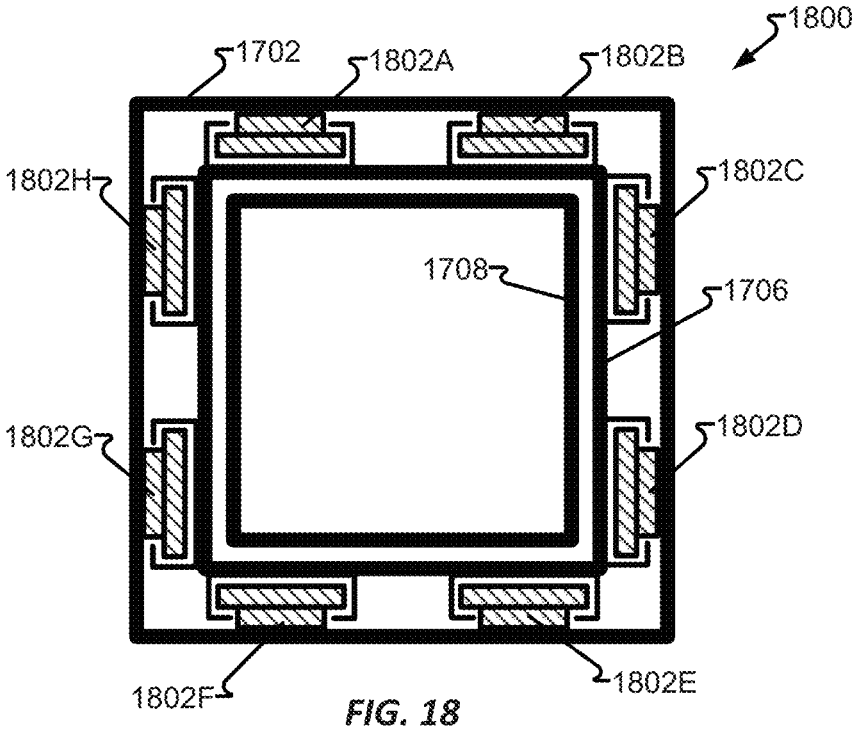
FIG. 18 depicts a cross-sectional view of a second support structure for a sit-stand desk, in accordance with embodiments of the present disclosure.

FIG. 18 depicts cross-sectional view 1800 of a second support structure for a sit-stand desk. In one embodiment, middle column 1706 is maintained within middle column 1708 via pairs of slidable tracks 1802, such as slidable tracks 1802A-H.

Figure 19:
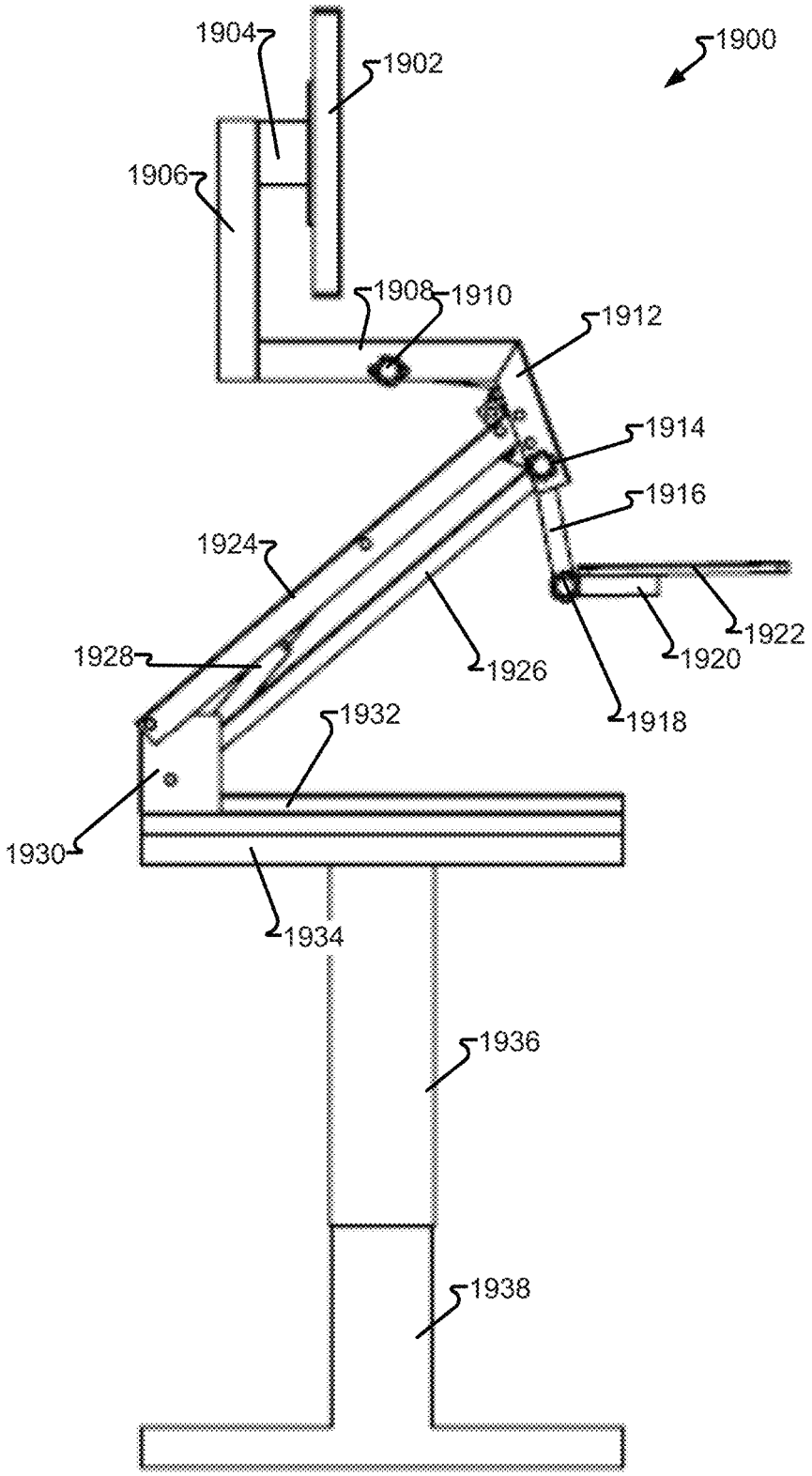
FIG. 19 depicts a side view of alternative sit-stand desk, in accordance with embodiments of the present disclosure.

FIG. 19 depicts a side view of sit-stand desk 1900. In one embodiment, standing desk 1900 is a sit-stand conversion desk, such that feet 1938, legs 1936, and base support 1934, providing a supporting surface of sit-stand desk 1900. In another embodiment, feet 1938, legs 1936, and base support 1934 are integrated when sit-stand desk 1900 is self-supporting.

In another embodiment, sit-stand desk 1900 comprises desk base 1934 attached to bracket 1930 and, attached to bracket 1930, first arm 1920, second arm 1926, and lifting motor 1928. Lifting motor 1928 may be embodied as an electrically powered lifter (e.g., linear motor, actuator, etc.), spring (with powered and/or manual assist), pneumatic, hydraulic, and/or other device operable to apply a selective force between bracket 1930 and first arm 1924. First arm 1924, second arm 1926, bracket 1930, and receiving member 1912 may be configured to maintain the relative angle of receiving member 1912 throughout the travel of receiving member 1912 and first arm 1924 and second arm 1926.

In another embodiment, receiving member 1912 comprises, at least a portion, of keyboard and/or monitor linkage such as to determine a relative height differential between keyboard track 1922 and monitor 1902 when in raised and lowered positions.

Receiving member 1912 may have attached thereto, keyboard tray 1922, such as via first keyboard support 1916 and second keyboard support 1920. The angle between first keyboard support 1016 and second keyboard support 1920, and therefore the angle of keyboard tray 1922 relative to a surface supporting sit-stand desk 1900, may be determined by knob 1918 providing a friction and/or attachment force between first keyboard support 1916 and second keyboard support 1920.

In another embodiment, receiving member 1912 may be affixed to first monitor support 1908, which in turn is attached to second monitor support 1906, which is in turn attached to third monitor support 1904. Knob 1910 provides a relative position for linkage (not shown and discussed more completely with respect to FIG. 21) which, based on a lifting force applied to receiving member 1912, affects the relative height of monitor 1902 via a variable relationship between first monitor support 1908 and second monitor support 1906 and/or second monitor support 1906 and third monitor support 1904.

Figure 20C:
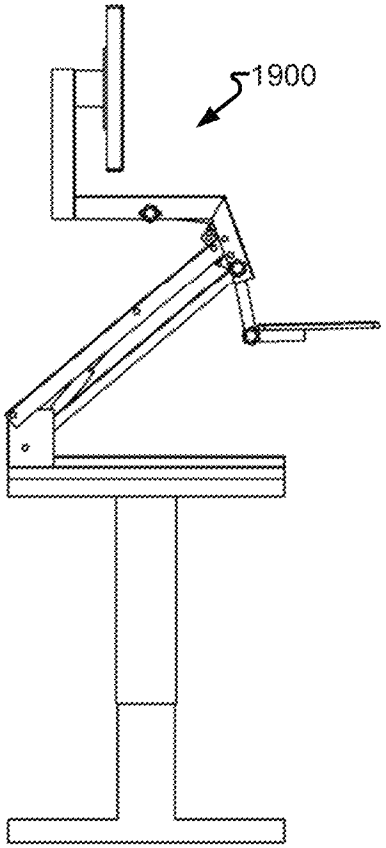
FIGS. 20A-C depict a side view of alternative sit-stand desk in various positions, in accordance with embodiments of the present disclosure.
Figure 20B:
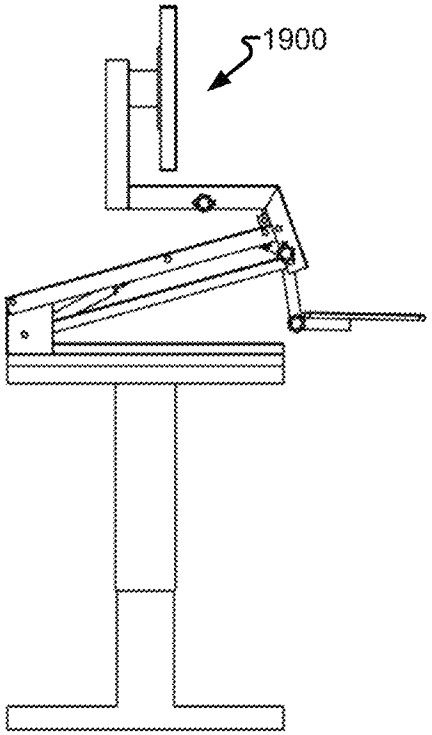
Figure 20A:
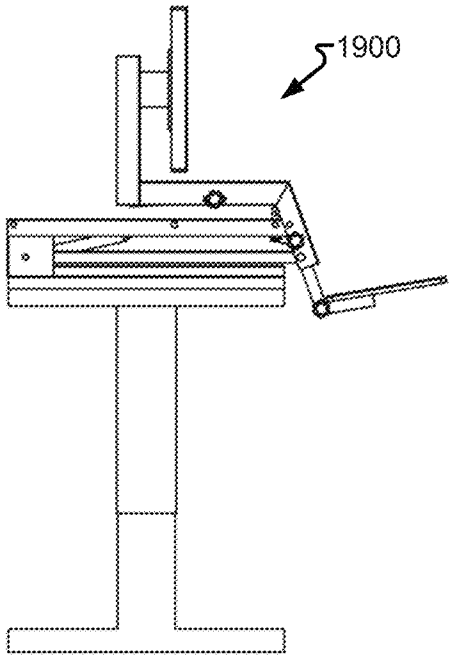

FIGS. 20A-C each depict a side view of sit-stand desk 1900 in various positions. FIG. 20A illustrates sit-stand desk 1900 in a lowered position, FIG. 20B illustrates sit-stand desk 1900 in an intermediate position, and FIG. 20C illustrates sit-stand desk 1900 in a raised position. The lowered position illustrated in FIG. 20A may be utilized by a seated user. The intermediate and/or raised position, illustrated in FIGS. 20B and 20C, respectively, may be utilized by a standing, walking, running, or jogging user. Additionally, or alternatively, FIG. 20B may be a transitional position as standing desk 1900 transitions between lowered position, as illustrated in FIG. 20A and raised position, as illustrated in FIG. 20C.

Figures 21A, 21B:
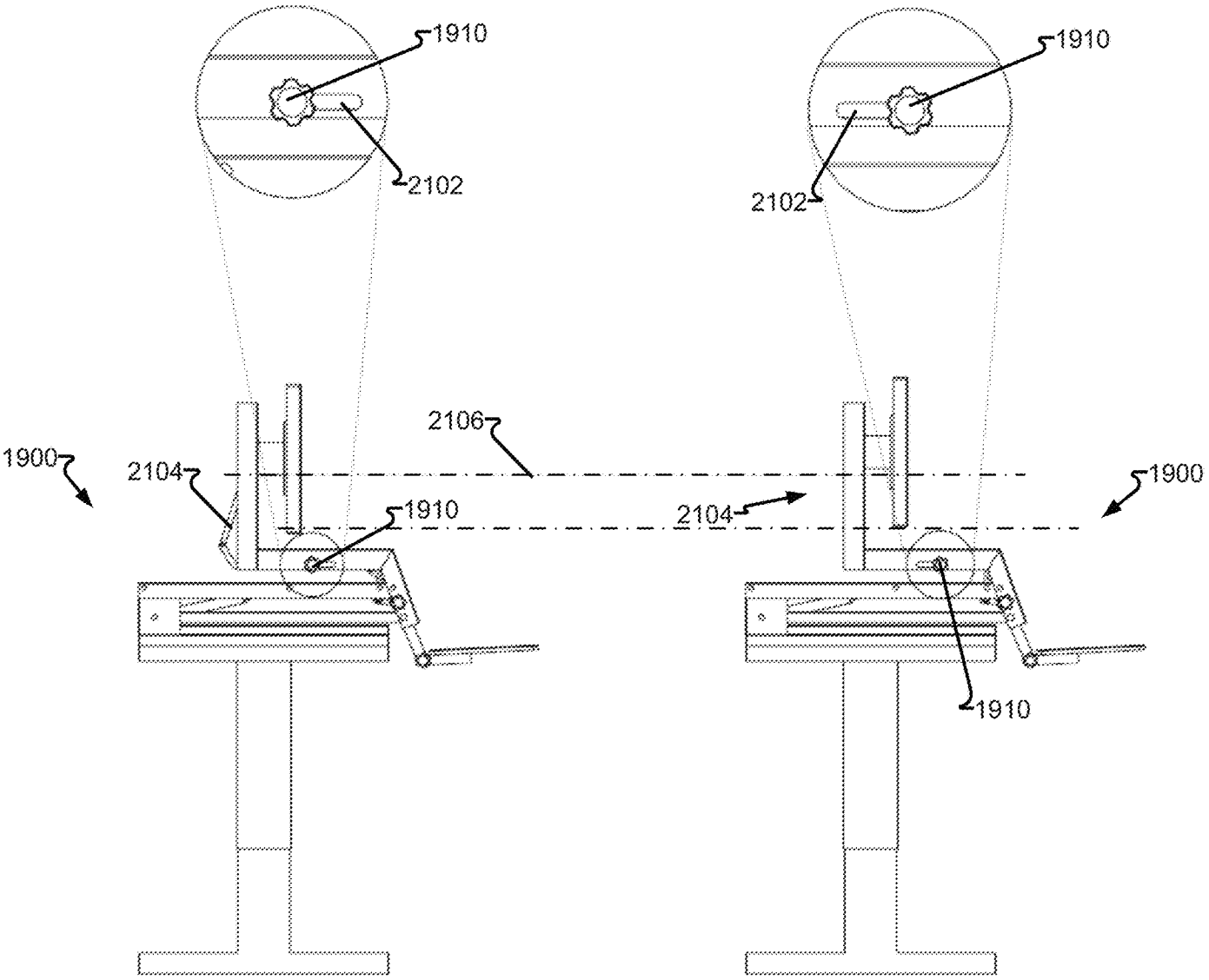
FIGS. 21A-B depict a side view of alternative sit-stand desk illustrating a first height differential, in accordance with embodiments of the present disclosure.

FIGS. 21A-B each depict a side view of sit-stand desk 1900 illustrating a first height differential when sit-stand desk 1900 is in a lowered configuration. In one embodiment, as illustrated in FIG. 21A, knob 1910 is displaced to the left of slot 2102, thereby causing a first position of linkage 2104. As a result, sit-stand desk 1900 has monitor height 2106. In another embodiment, as illustrated in FIG. 21B, knob 1910 is displaced to the right of slot 2102, thereby placing linkage 2104 in a second position. Each of the embodiments illustrated by FIGS. 21A and 21B comprise a monitor height of 2106.

Figures 22A, 22B:
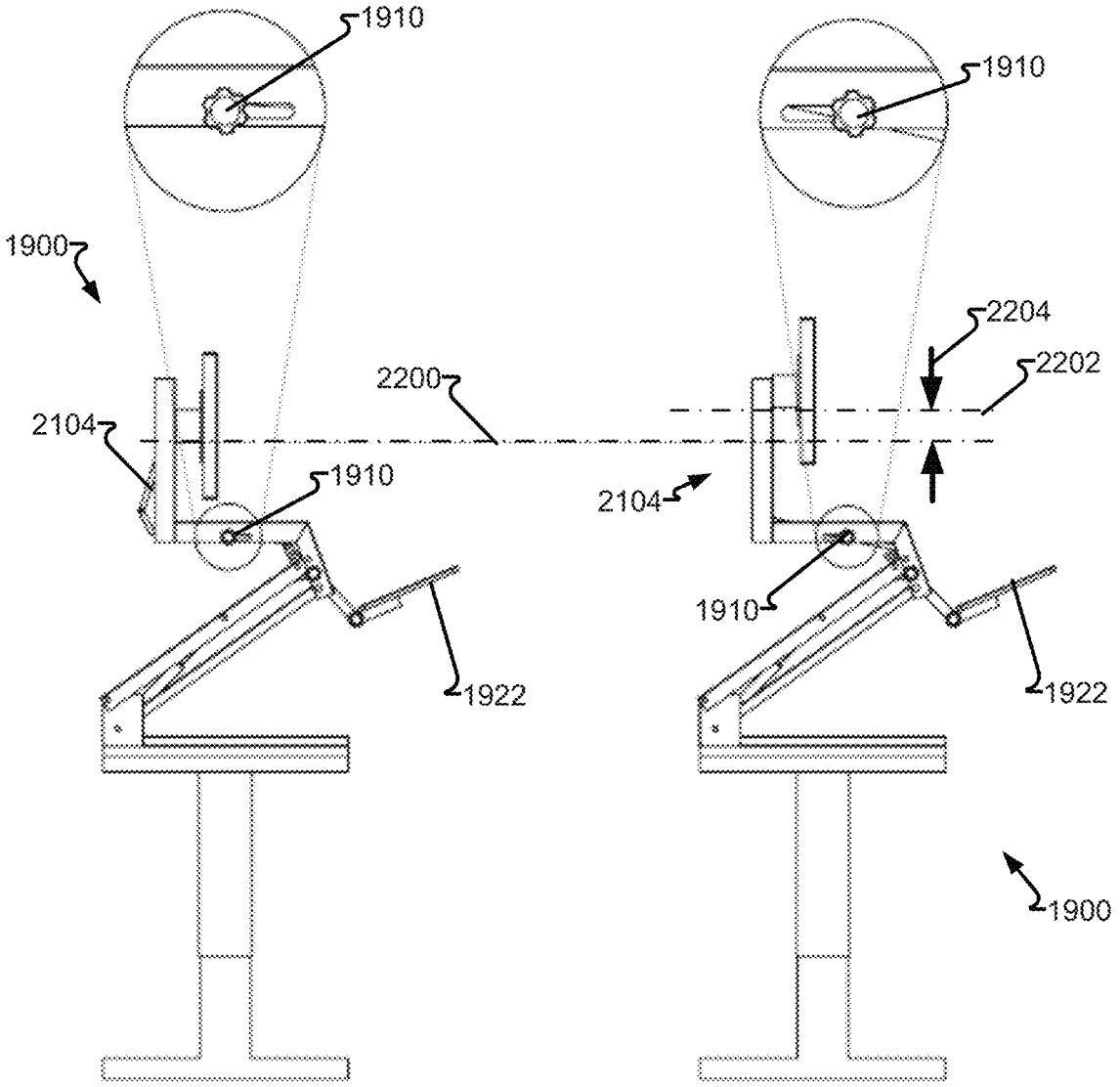
FIGS. 22A-B depict a side view of alternative sit-stand desk illustrating a second height differential, in accordance with embodiments of the present disclosure.

FIGS. 22A-B depict a side view sit-stand desk 1900 illustrating a second height differential when sit-stand desk 1900 is in a raised configuration. In one embodiment, as illustrated in FIG. 22A, knob 1910 is disposed in the left portion of slot 2102, and thereby placing linkage 2104 in the first position. In another embodiment, as illustrated in FIG. 22B, knob 1900 is disposed in the right portion of slot 2102, and thereby placing linkage in the second position. As a result, when sit-stand desk 1900 is raised, in the embodiment illustrated by FIG. 22A, monitor height 2200 is provided. In the embodiment illustrated by FIG. 22B, monitor height 2202 is provided, resulting in a height differential 2204. Keyboard support 1922 is substantially unaffected by the position of knob 1910.

Figure 23:
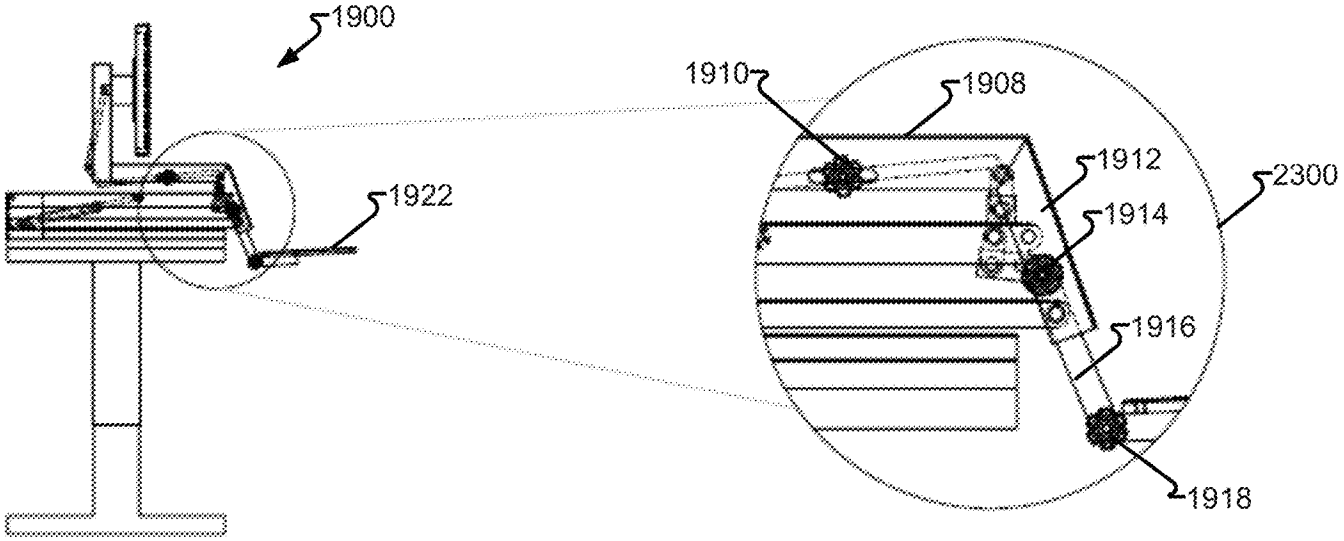
FIG. 23 depicts a side view of an adjustable linkage, in accordance with embodiments of the present disclosure.

FIG. 23 depicts a side view of an adjustable linkage 2300 of sit-stand desk 1900. in one embodiment, sit-stand desk 1900 comprise linkage 2300. Linkage 2300 may then comprise knob 1910, first monitor support 1908, receiving member 1912, knob 1914, first keyboard support 1916, and knob 1918. Linkage 2300 may further comprise additional components.

In another embodiment, knob 1914 is selectively positioned.

Figure 24A:
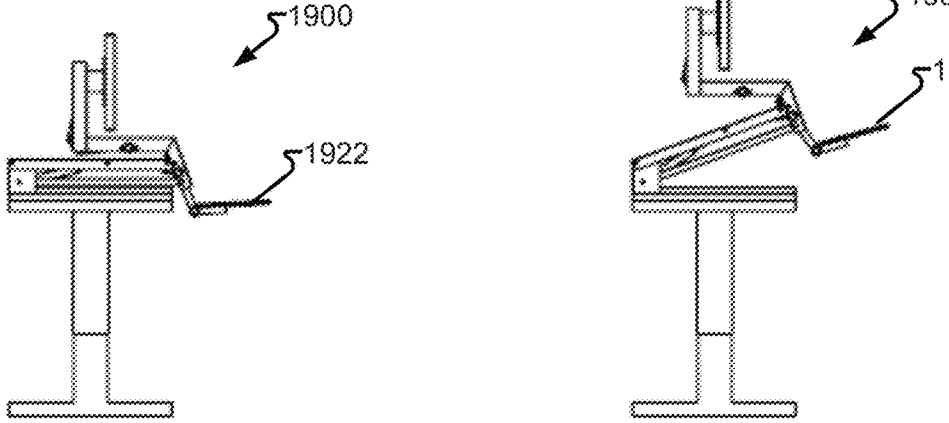
FIG. 24A-C depict a side view of an adjustable linkage and attached keyboard tray, in accordance with embodiments of the present disclosure.
Figure 24B:
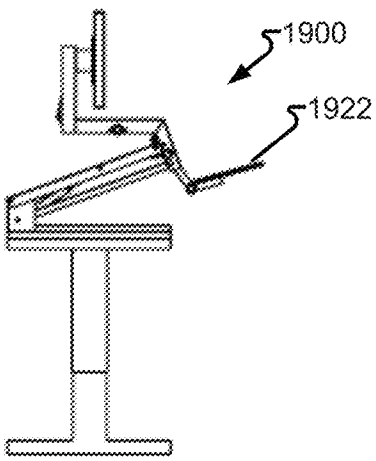
Figure 24C:
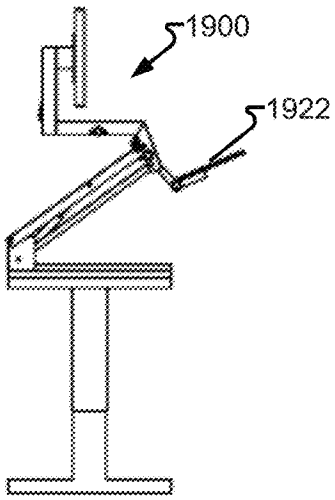

FIG. 24A-C depict a side view of sit-stand desk 1900. In one embodiment, the position of knob 1914 is variably selected to cause, for example, the configuration illustrated by one or more of FIGS. 24A-C.

Figure 25A:
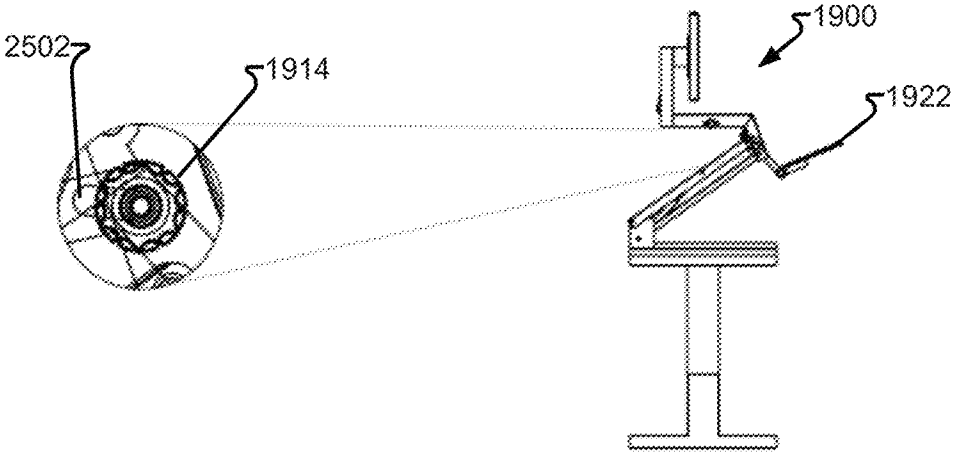
FIG. 25A-C depict a side view of an adjustable linkage and attached keyboard tray, in accordance with embodiments of the present disclosure.
Figure 25B:
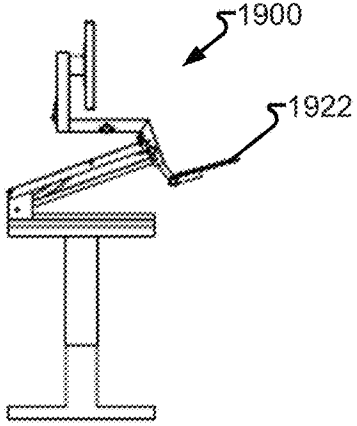
Figure 25C:
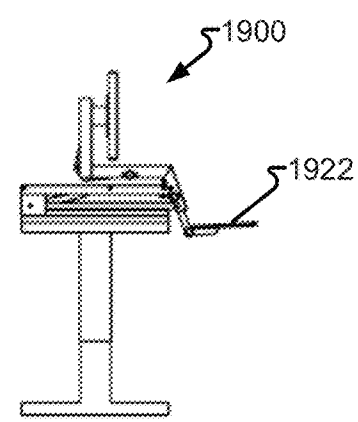

FIG. 25A-C depict side view sit-stand desk 1900. In one embodiment, knob 1914 is disposed in a right-most position of slot 2502 and, via linkage of sit-stand desk 1900, provides for variable positions of keyboard tray 1922, such as illustrated by FIG. 25A, in a raised position, 25B, in an intermediate position, and 25C, in a lowered position.

Figure 26A:
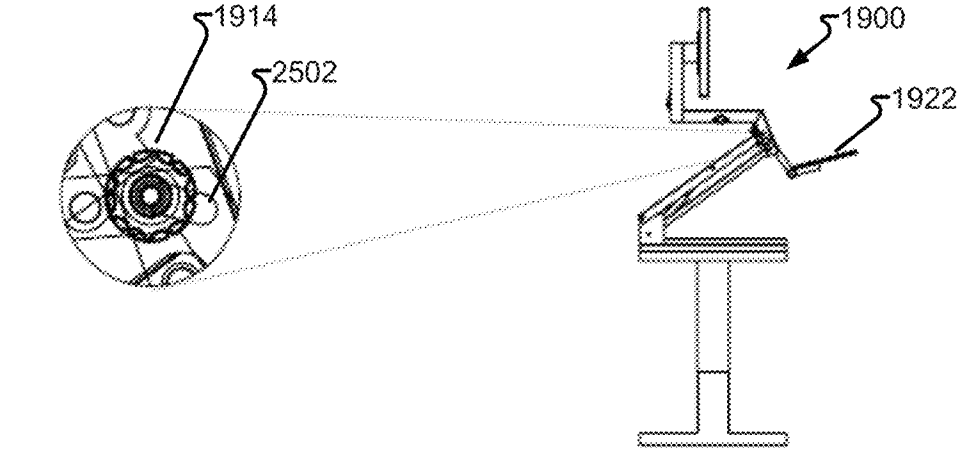
FIG. 26A-C depict a side view of an adjustable linkage and attached keyboard tray, in accordance with embodiments of the present disclosure.
Figure 26B:
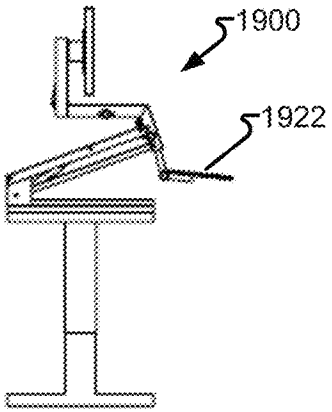
Figure 26C:
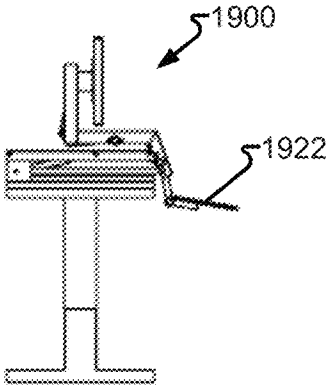

FIG. 26A-C depict side view sit-stand desk 1900. In one embodiment, knob 1914 is disposed in a left-most position of slot 2502 and, via linkage of sit-stand desk 1900, provides for variable positions of keyboard tray 1922, such as illustrated by FIG. 25A, in a raised position, 25B, in an intermediate position, and 25C, in a lowered position.

Figure 27:
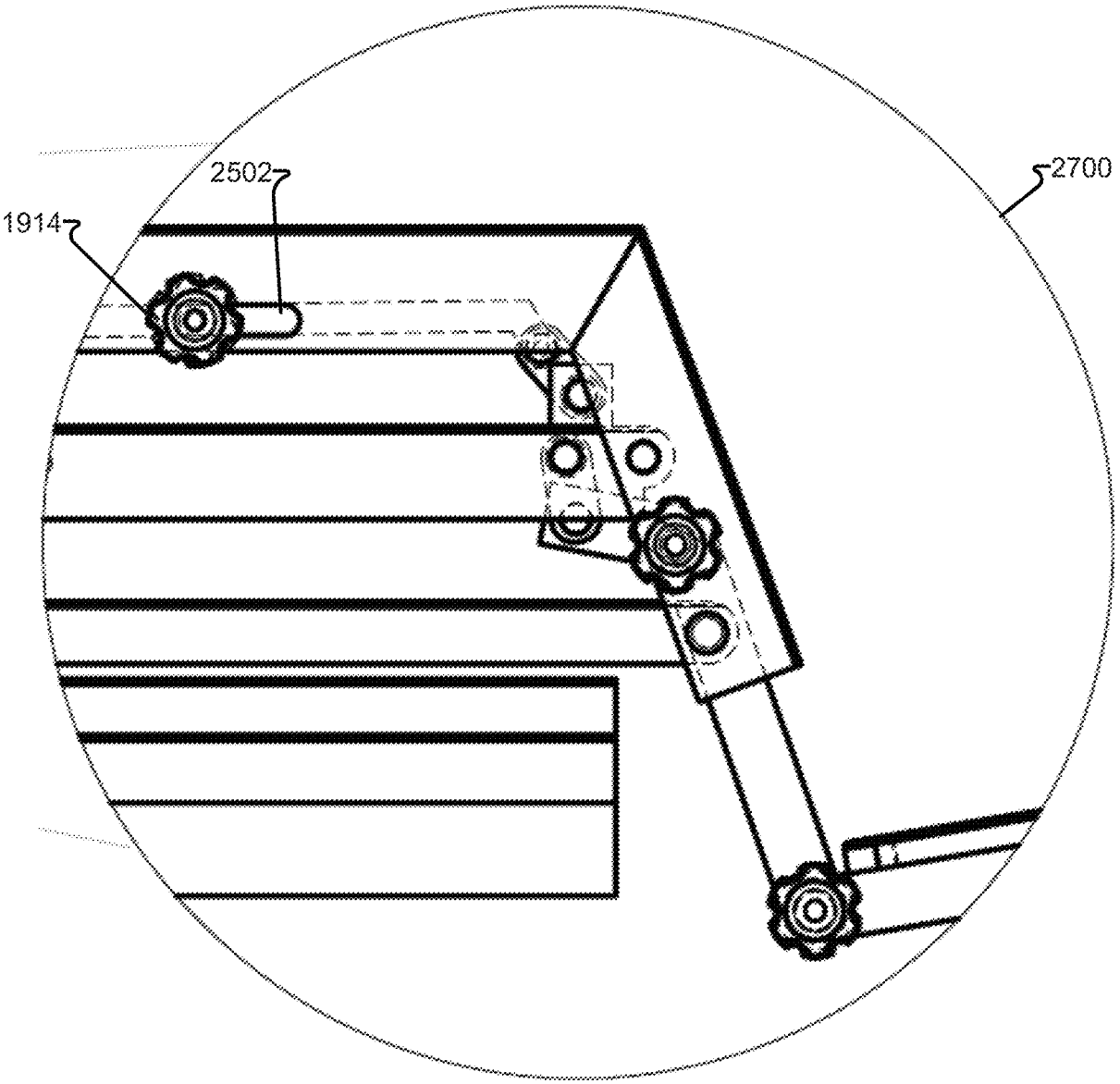
FIG. 27 depicts an enhanced view of standing desk linkage in a first position, in accordance with embodiments of the present disclosure.

FIG. 27 depicts enhanced view 2700 of standing desk linkage in a first position. The first position comprising knob 1914 in a left-most position within slot 2502.

Figure 28:
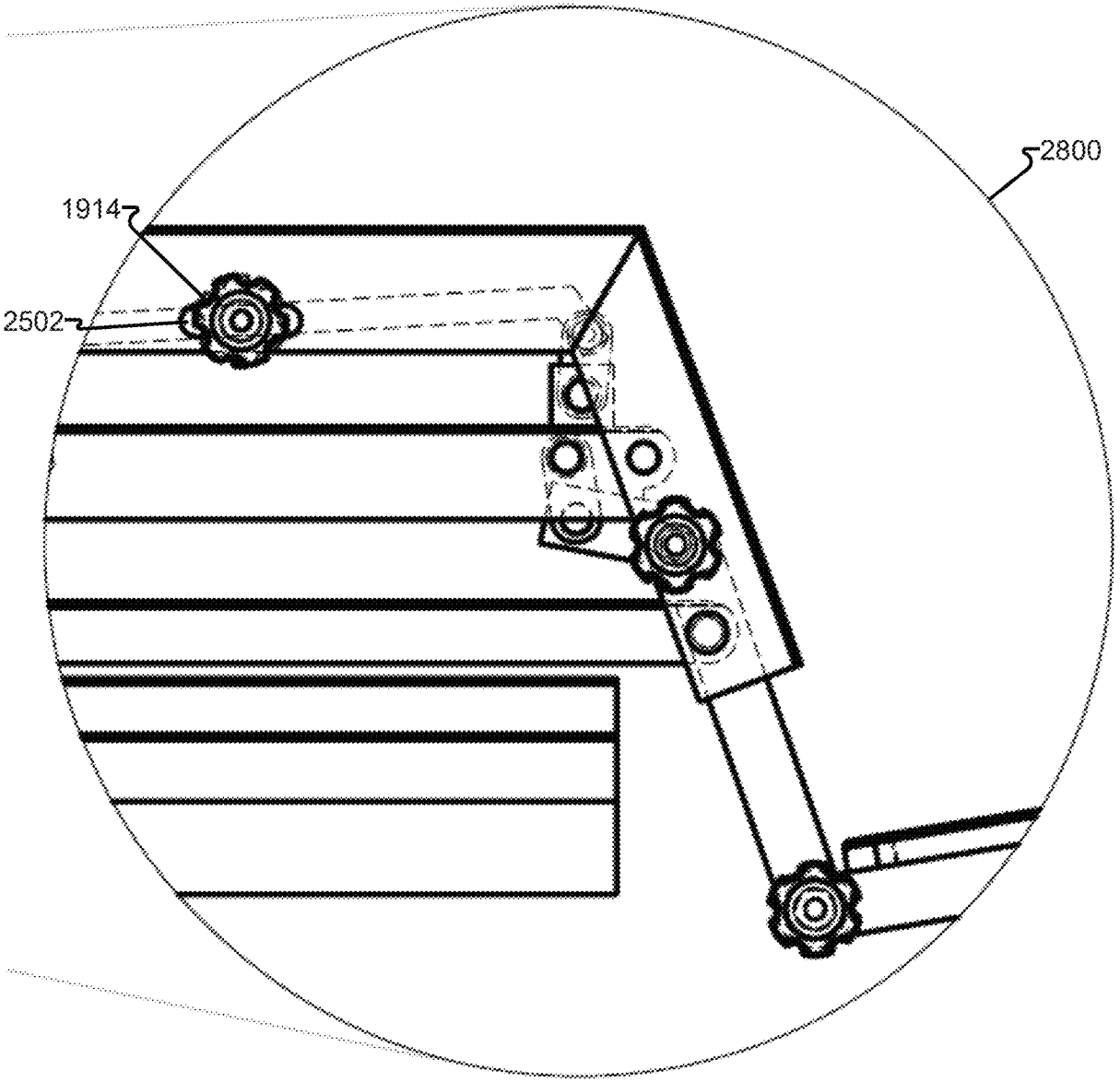
FIG. 28 depicts an enhanced view of standing desk linkage in a second position, in accordance with embodiments of the present disclosure.

FIG. 28 depicts enhanced view 2800 of standing desk linkage in a second position. The second position comprising knob 1914 in a middle position within slot 2502.

Figure 29:
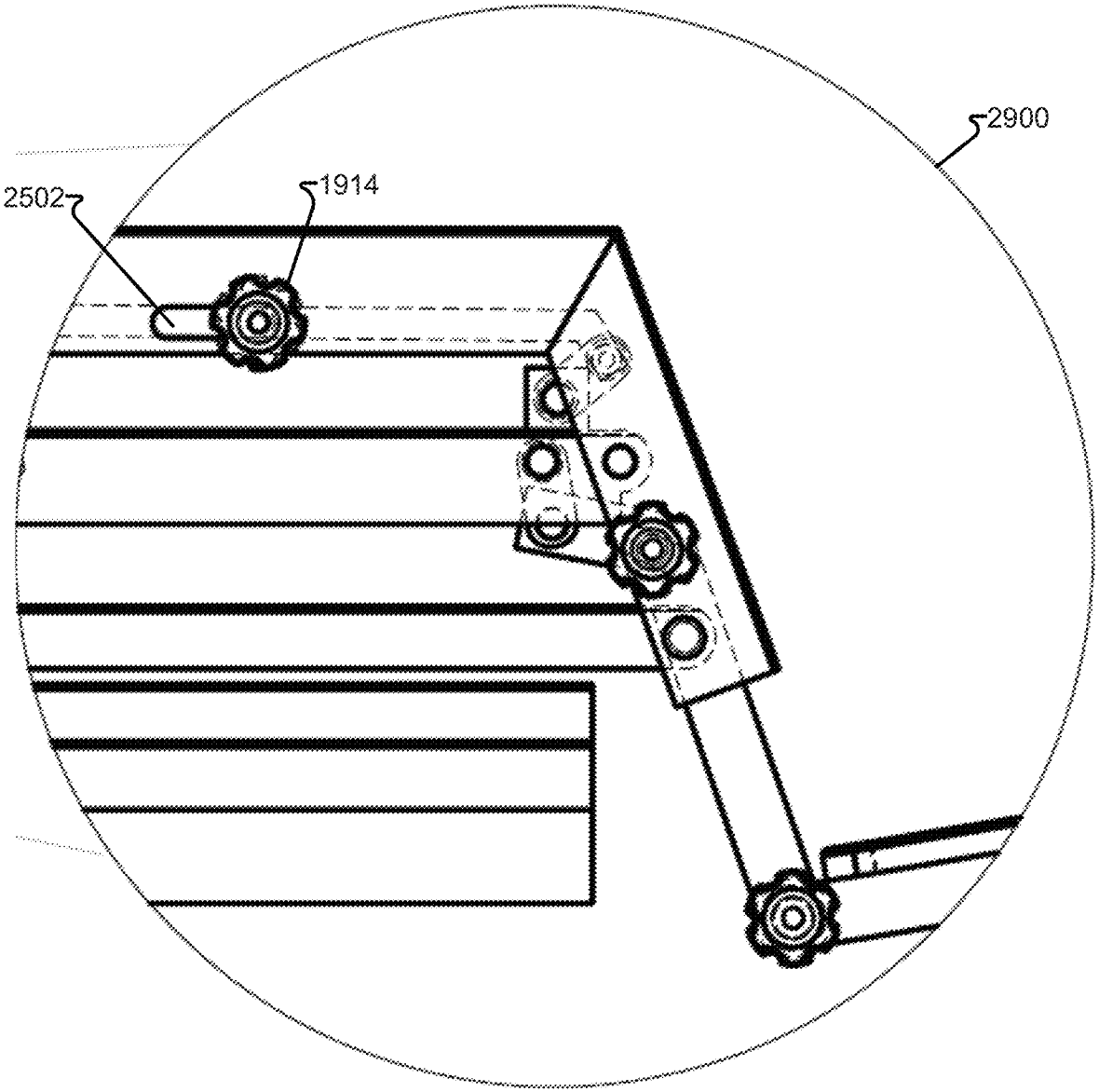
FIG. 29 depicts an enhanced view of standing desk linkage in a third position, in accordance with embodiments of the present disclosure.

FIG. 29 depicts enhanced view 2900 of standing desk linkage in a third position. The third position comprising knob 1914 in a right-most position within slot 2502.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments, configurations, or aspects for the purpose of streamlining the disclosure. The features of the embodiments, configurations, or aspects of the invention may be combined in alternate embodiments, configurations, or aspects other than those discussed above. This method of disclosure is not to be interpreted as reflecting an intention that the claimed invention requires more features than are expressly recited in each claim. Rather, as the following claims reflect, inventive aspects lie in less than all features of a single foregoing disclosed embodiment, configuration, or aspect. Thus, the following claims are hereby incorporated into this Detailed Description, with each claim standing on its own as a separate preferred embodiment of the invention.

Moreover, though the description of the invention has included description of one or more embodiments, configurations, or aspects and certain variations and modifications, other variations, combinations, and modifications are within the scope of the invention (e.g., as may be within the skill and knowledge of those in the art, after understanding the present disclosure). It is intended to obtain rights, which include alternative embodiments, configurations, or aspects to the extent permitted, including alternate, interchangeable and/or equivalent structures, functions, ranges, or steps to those claimed, whether or not such alternate, interchangeable and/or equivalent structures, functions, ranges, or steps are disclosed herein, and without intending to publicly dedicate any patentable subject matter.

What is claimed is:

1. An adjustable-height computer desk, comprising:

a base;

a telescoping column, wherein the telescoping column comprises a first column attached to the base, a second column slidably attached to the first column, and a third column slidably attached to the second column; and a lifting mechanism, wherein a lifting force applied to one of the second column or the third column differentially lifts both the second column and the third column;

an adjustment stop, the adjustment stop engaging the third column at a variable location, the variations in the variable location comprising positions in direction of travel of the third column relative to the second column; and wherein the lifting force applied to one of the second column or the third column causes the relative distance between a monitor support, attached to the third column, and a keyboard support, attached to the second column to be increased, when the adjustable height computer desk is configured for standing use, over the relative distance between the monitor support and keyboard support when the adjustable height desk is configured for seated use; and wherein the adjustment stop, engages a limiting portion of the second column and transfer the lifting force to the third column, via the adjustment stop, to the second column.

2. The adjustable-height computer desk of claim 1, wherein the lifting force, when less than the force of gravity, differentially lowers both the second column and the third column.

3. The adjustable-height computer desk of claim 1, wherein the lifting force, when less than the force of gravity, causes the adjustment stop to disengage a limiting portion of the second column and allow the third column to be lowered relative to the second column.

4. The adjustable-height computer desk of claim 3, wherein the adjustment stop is fixed in position to the first column.

5. The adjustable-height computer desk of claim 1, wherein:

the third column comprises a first slot along direction of travel of the third column relative to the second column;

the second column comprises a second slot along the direction of travel of the second column relative to the third column;

third column, upon receiving the lifting force, causes a limit of the first slot to engage the adjustment stop and cause the adjustment stop to travel to a limit of the second slot and, upon reaching the limit of the second stop, transfers the lifting force to the second column.

6. The adjustable-height computer desk of claim 1, wherein the base comprises a planar portion to engage a supporting platform and the telescoping column forms a non-perpendicular and non-parallel angle to the base.

7. The adjustable-height computer desk of claim 6, wherein the non-perpendicular and non-parallel angle formed by the telescoping column and the base, comprises an angle between 5 degrees and 20 degrees from perpendicular.

8. An adjustable-height computer desk, comprising:

a base for supporting the adjustable-height desk;

a telescoping column, wherein the telescoping column comprises a first column attached to the base, a second column slidably attached to the first column, and a third column slidably attached to the second column;

a keyboard support configured to support a computer input device for receiving manual inputs from a user and attached to the second column;

a monitor support configured to support a computer display device for presenting visual information to the user attached to the third column;

wherein the keyboard support and monitor support, when in a first position, have a first height differential; and a lifting mechanism, wherein a lifting force applied to one of the second column or the third column differentially lifts both the second column and the third column to cause the keyboard support and monitor support to move from the first position toward the second position; and wherein the keyboard support and monitor support, when in a second position, have a second height differential different from the first height differential;

wherein the lifting force applied to one of the second column or the third column causes the relative distance between the monitor support and the keyboard support to be increased, when the adjustable height computer desk is configured for standing use, over the relative distance between the monitor support and keyboard support when the adjustable height desk is configured for seated use; and wherein the horizontal distance of the monitor support between the first position and the second position, is greater than the horizontal distance of the keyboard support between the first position and the second position.

9. The adjustable-height computer desk of claim 8, further comprising a motor that, when energized, provides the lifting force.

10. The adjustable-height computer desk of claim 8, further comprising a catch to hold at least the second column to the first column or the second column to the third column that, when released, receives the lifting force from the user.

11. The adjustable-height computer desk of claim 8, wherein the third column, upon receiving the lifting force, is raised in a first portion of travel wherein the second column remains stationary and, upon engaging an adjustable stop, is raised in a second portion of travel wherein the second column is raised with the third column.

12. The adjustable-height computer desk of claim 8, wherein the lifting mechanism comprises an electromechanical device.

13. The adjustable-height computer desk of claim 8, wherein the lifting mechanism comprises a manually activated support.

* * * * *